United States Patent [19]

Tury et al.

[11] Patent Number: 4,649,947

[45] Date of Patent: Mar. 17, 1987

[54] EXPANDABLE SOFT SIDE SHELTER

[75] Inventors: Keith A. Tury, DeLand; Ronald D. Evans, Deltona, both of Fla.

[73] Assignee: Brunswick Corporation, Skokie, Ill.

[21] Appl. No.: 611,851

[22] Filed: May 18, 1984

Related U.S. Application Data

[63] Continuation-in-part of Ser. No. 525,001, Aug. 19, 1983, which is a continuation-in-part of Ser. No. 410,521, Aug. 23, 1982, abandoned.

[51] Int. Cl.[4] ..... E04H 15/18; E04H 15/46; E04H 15/58; E04H 15/48

[52] U.S. Cl. ..... 135/97; 135/107; 135/112; 135/117; 135/DIG. 9

[58] Field of Search ..... 135/102, 97, 103, 110, 135/115, 116, 119, 93, 94, 91; 52/109, 63; 403/100, 102, 113, 295, 73; 16/234, 374, 378, 392

[56] References Cited

U.S. PATENT DOCUMENTS

| | | | |
|---|---|---|---|
| 503,135 | 8/1893 | Groves | 403/73 |
| 656,033 | 8/1900 | Miller | 135/94 |
| 1,648,724 | 11/1927 | Dakin | 135/115 X |
| 2,201,984 | 5/1940 | Clark | 135/115 X |
| 2,643,911 | 6/1953 | Lyon | 135/115 |
| 2,797,696 | 7/1957 | Fritsche | 135/102 |
| 2,812,769 | 11/1957 | Schaefer et al. | 135/115 X |
| 3,131,705 | 5/1964 | Marino | 135/103 |
| 3,148,662 | 9/1964 | Morrell | 135/115 |
| 3,256,896 | 6/1966 | Cummins | 135/97 |
| 3,441,037 | 4/1969 | Transeau | 135/97 |
| 3,503,101 | 3/1970 | Kolozsuary | 135/119 |
| 3,526,066 | 9/1970 | Hagar et al. | 52/109 |
| 3,811,454 | 5/1974 | Huddle | 135/97 |
| 3,863,660 | 2/1975 | Glaeser | 135/115 X |
| 3,894,766 | 7/1975 | Woodward | 135/115 X |
| 4,036,244 | 7/1977 | Huddle | 135/102 |
| 4,066,089 | 1/1978 | Rainwater | 135/102 |
| 4,078,572 | 3/1978 | Moss | 135/97 |

FOREIGN PATENT DOCUMENTS

| | | | |
|---|---|---|---|
| 91494 | 10/1983 | European Pat. Off. | 135/101 |
| 470241 | 8/1937 | United Kingdom | 135/109 |
| 732753 | 6/1955 | United Kingdom | 135/101 |
| 2121850 | 1/1984 | United Kingdom | 135/115 |

*Primary Examiner*—Robert A. Hafer
*Assistant Examiner*—D. Neal Muir
*Attorney, Agent, or Firm*—William G. Lawler, Jr.; George J. Porter

[57] ABSTRACT

An expandable multi-purpose utility shelter (10), designed in several sizes, which is quickly erectable by two to six persons. The structure has a sturdy metal frame (12, 16) with a durable fabric cover (11) attached to the inside of the frame. The frame (12, 16) comprises a series of ribs (12) which can be very quickly and easily extended from a compact folded configuration needed for easy transportation to a full sized shelter at erection. Adjacent ribs (12) are connected by a single reinforcing member (16) or by X-shaped reinforcing members (**16*a*) on each side of the shelter. These reinforcing members serve as force transmitting means for opening and closing the shelter (10) and keeping adjacent ribs (12) stabilized and spaced equidistant. Individual reinforcing members (16 or 16*a*) are pivotally connected to the lower portion of one shelter leg and rollably or slidably connected to the upper portion of a next adjacent shelter leg. The ribs (12) are equipped with a plurality of sturdy hinges (270) which are designed to prevent the ribs (12) from folding when in the erected position and to prevent pinching and damaging the cover when the shelter is folded. Hinges (270) are capable of rotating 120 degrees from the fully open to the fully closed positions. The design of the shelter (10) provides for attaching a thermal liner (287) and thermal floor (312) to the cover (11) with hook and pile fasteners (288 and 290) so that the shelter (10) may be folded without removing the liner (287) and floor (312). A plenum or duct (298) is attached to liner (287) for air conditioning or heating. A thermal barrier (326) and thermal barrier stand-offs (324 and 327) may be added to the shelter (10**) to insulate the shelter from direct sunlight.

33 Claims, 92 Drawing Figures

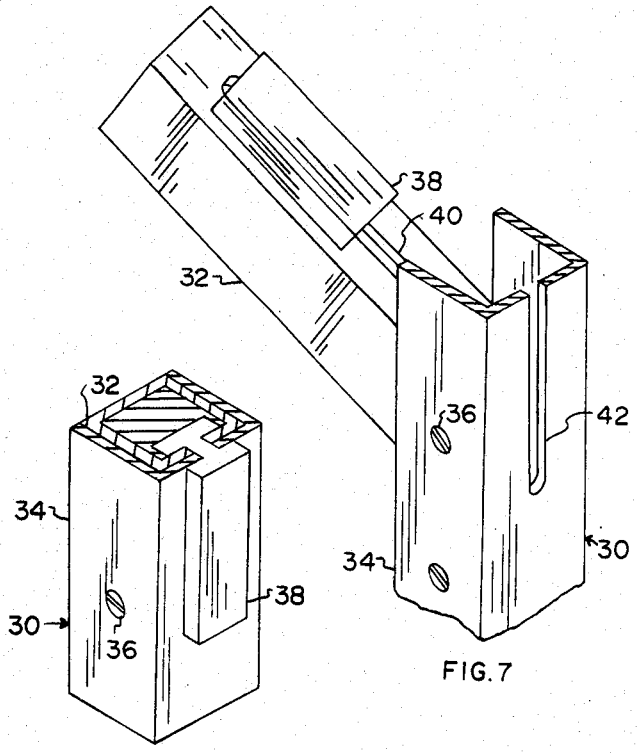
FIG.6
FIG.7
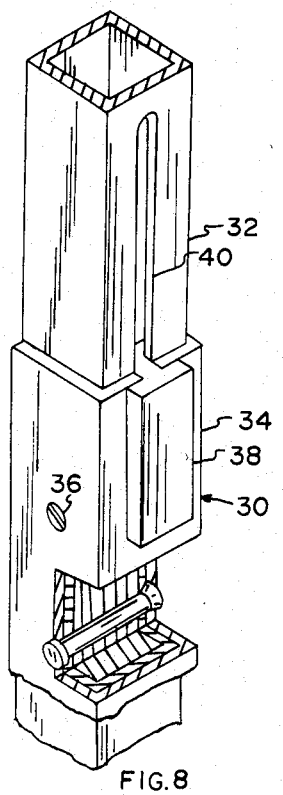
FIG.8
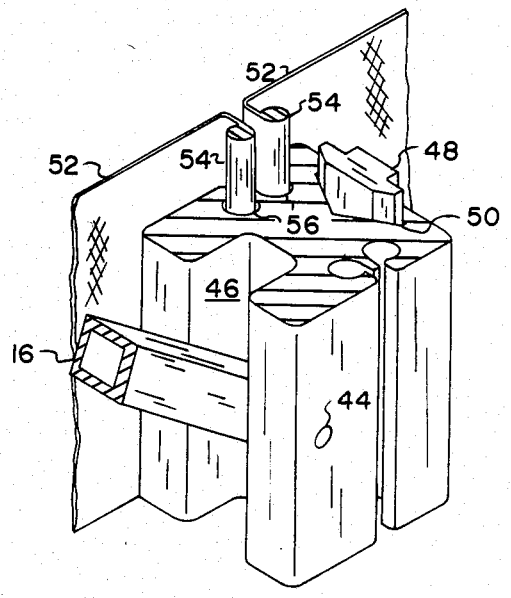
FIG.9

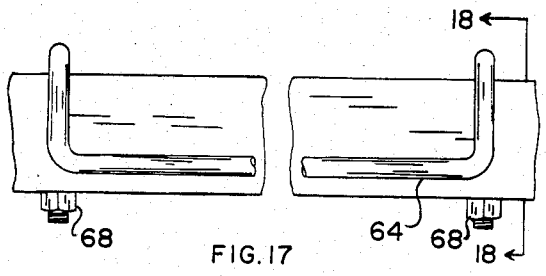
FIG. 17
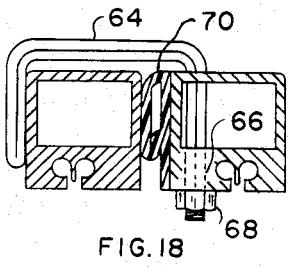
FIG. 18
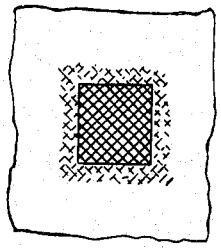
FIG. 19
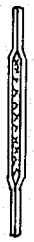
FIG. 20
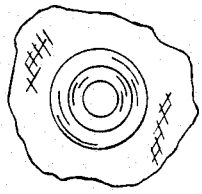
FIG. 21
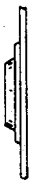
FIG. 22
FIG. 23
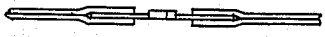
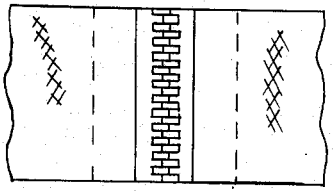
FIG. 24
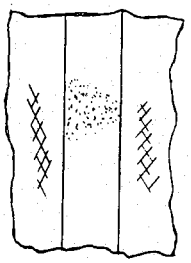
FIG. 25
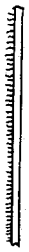
FIG. 26

EXPANDABLE SOFT SIDE SHELTER

CROSS REFERENCE TO RELATED APPLICATIONS

This application is a continuation-in-part of the copending application of Keith A. Tury and Ronald D. Evans, Ser. No. 525,001, now allowed "Expandable Soft Side Shelter," filed Aug. 19, 1983, which was a continuation-in-part of Ser. No. 410,521, now abandoned filed Aug. 23, 1982.

This application is related to U.S. patent application Ser. No. 480,230, "Expandable Shelter System Providing Collective Protection, " now abandoned as of Sept. 19, 1985 filed Mar. 30, 1983.

TECHNICAL FIELD

The present invention relates generally to portable shelters, and more particularly to a metal frame soft side expandable shelter that is sturdy, self-contained, easily repairable, and quickly erectable and may serve as an all-purpose utility structure.

BACKGROUND OF THE INVENTION

In the past a wide variety of portable shelters have been used to include tents and similar structures, inflatable structures, geodesic domes, and various types of pre-fabricated structures. Tents have the advantage of being quick to erect while pre-fabricated structures have the advantage of being sturdier, more permanent, and more capable of withstanding weather. The ideal portable shelter would be quick and easy to erect, yet sturdy and capable of withstanding windy and stormy weather.

U.S. Pat. No. 3,256,896 to Phil F. Cummins was an improvement over some of the previously known portable shelters cited therein. However, the device disclosed and claimed by the Cummins patent has several disadvantages. Its framework was too heavy, its hinges and hardware and protrusions which could tear and damage the attached cover, and its cover was difficult to remove for the purpose of repair or replacement. The present application discloses a device which is an improvement over Cummins and is designed to overcome the disadvantages of the Cummins device. The present invention is designed to be lighter than the Cummins device, yet sturdy enough to remain serviceable over a long period of time. In addition, the present invention incorporates a number of features designed to make the invention easier to manufacture, more maintenance-free, and easier to repair. The advanced features and improvements of the present invention will be disclosed in detail hereinbelow.

Therefore, it is a general object of this invention to provide a lighter weight, sturdy, quickly erectable and strikeable, easily repairable, all-purpose utility structure capable of being made in several sizes.

SUMMARY OF THE INVENTION

The present invention is suitable for a wide variety of recreational, military, and business uses wherever a sturdy yet quickly erectable portable shelter is needed. This shelter is, of course, eminently suitable to a large number of uses by the military services, including personnel quarters, command and administrative quarters, vehicle and weapons maintenance, storage of supplies, and for field hospitals. For large hospitals and higher military headquarters, a number of the units may be connected together to form complexes in a manner which will be disclosed fully below.

In accordance with the invention, there is provided an expandable utility structure comprising a support framework comprising a plurality of inverted U-shaped ribs, each rib having two legs and at least two hinges to permit the legs to be folded inwardly and the shelters to be folded into a compact package for storage and easy transportation. The framework also has a series of reinforcing members connecting and spacing the ribs, each reinforcing member being one single longitudinal member connected to two adjacent ribs. A second embodiment utilizes X-shaped reinforcing members connecting adjacent ribs. Each single reinforcing member and each individual member of an X-shaped reinforcing member is pivotally connected to the lower portion of one shelter leg and movably connected to the upper portion of a next adjacent shelter leg. The shelter further comprises a flexible cover removably secured to each rib member so that it pleats inwardly when the shelter is closed.

BRIEF DESCRIPTION OF THE DRAWINGS

A presently preferred embodiment of the invention will now be described in detail in connection with the accompanying drawings, wherein:

FIG. 6 shows an elevational view of an alternative (sliding) hinge (shown partially in section and in locked position) on a rib of the shelter frame.

FIG. 7 shows a view of the alternative sliding hinge of FIG. 6 (in an unlocked position).

FIG. 8 is an elevational view of the alternative sliding hinge of FIG. 6 in locked position with the hinge shown partially in cross section.

FIG. 9 is an elevational view of an aluminum extrusion rib showing how the two adjacent pieces of the fabric are attached to the rib and how the reinforcing members are attached to one side of the rib with a pivot pin and to the other side with of the rib with a slide.

FIG. 17 is an elevational view of the shelter connector assembly.

FIG. 18 is a sectional view of the connector assembly of FIG. 17 in latched position, with a weather seal.

FIG. 19 is a front view of a screen which is heatsealed to the shelter.

FIG. 20 is a sectional view of the screen shown in FIG. 19.

FIG. 21 is a front view of a grommet installation.

FIG. 22 is a side view of the grommet installation shown in FIG. 21.

FIG. 23 is a side view of the zipper installation.

FIG. 24 is a top view of the zipper installation shown in FIG. 23.

FIG. 25 is a top view of a hook and pile installation.

FIG. 26 is a side view of the hook and pile installation shown in FIG. 25.

DETAILED DESCRIPTION OF THE INVENTION

Figures 1, 2:
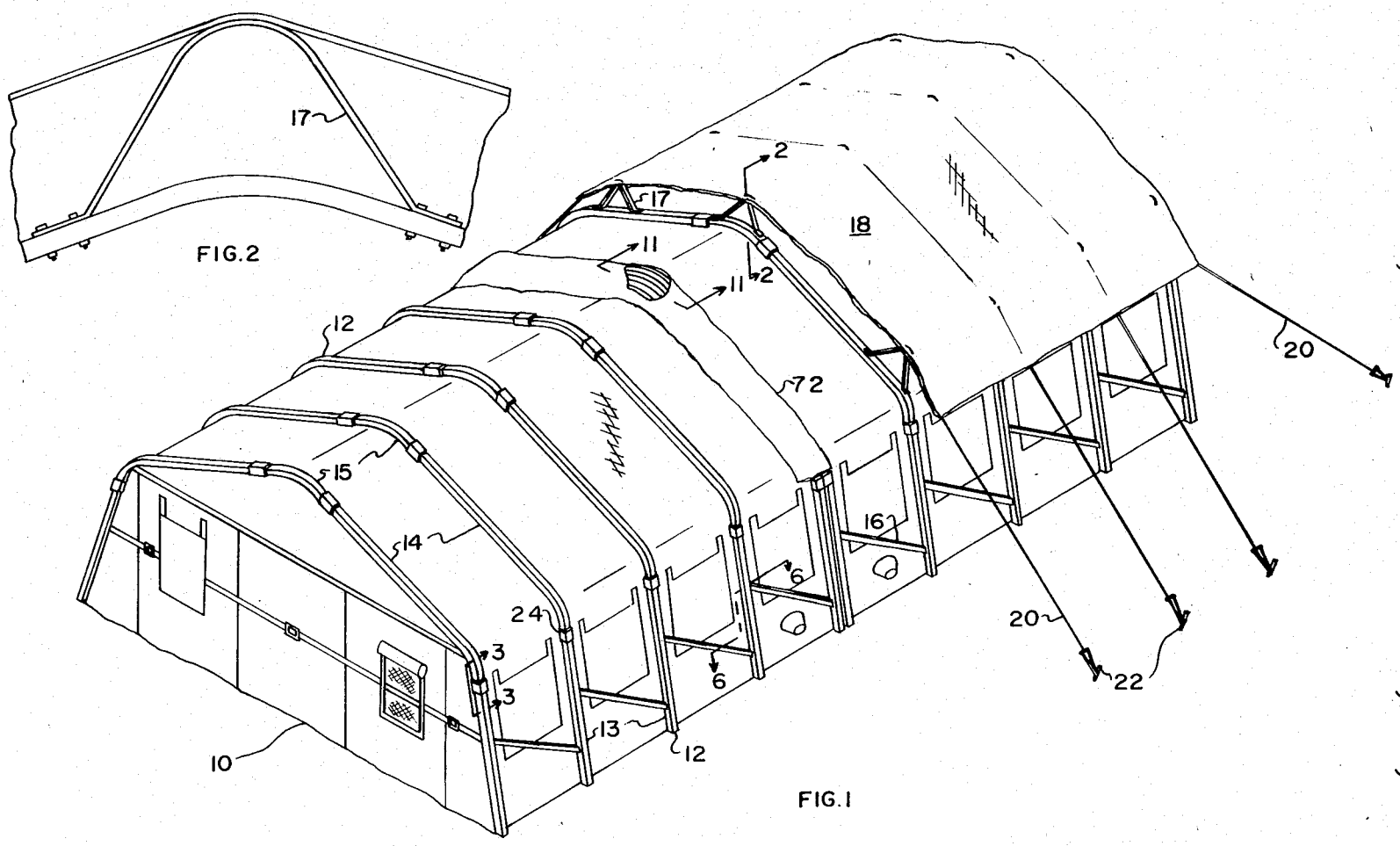
FIG. 1 is a pictorial illustration of the invention erected with a fly cover installed at the far end.
FIG. 2 is an elevational view of a ridge or eave extender for attaching a fly cover to the invention.
Figures 3A, 3B:
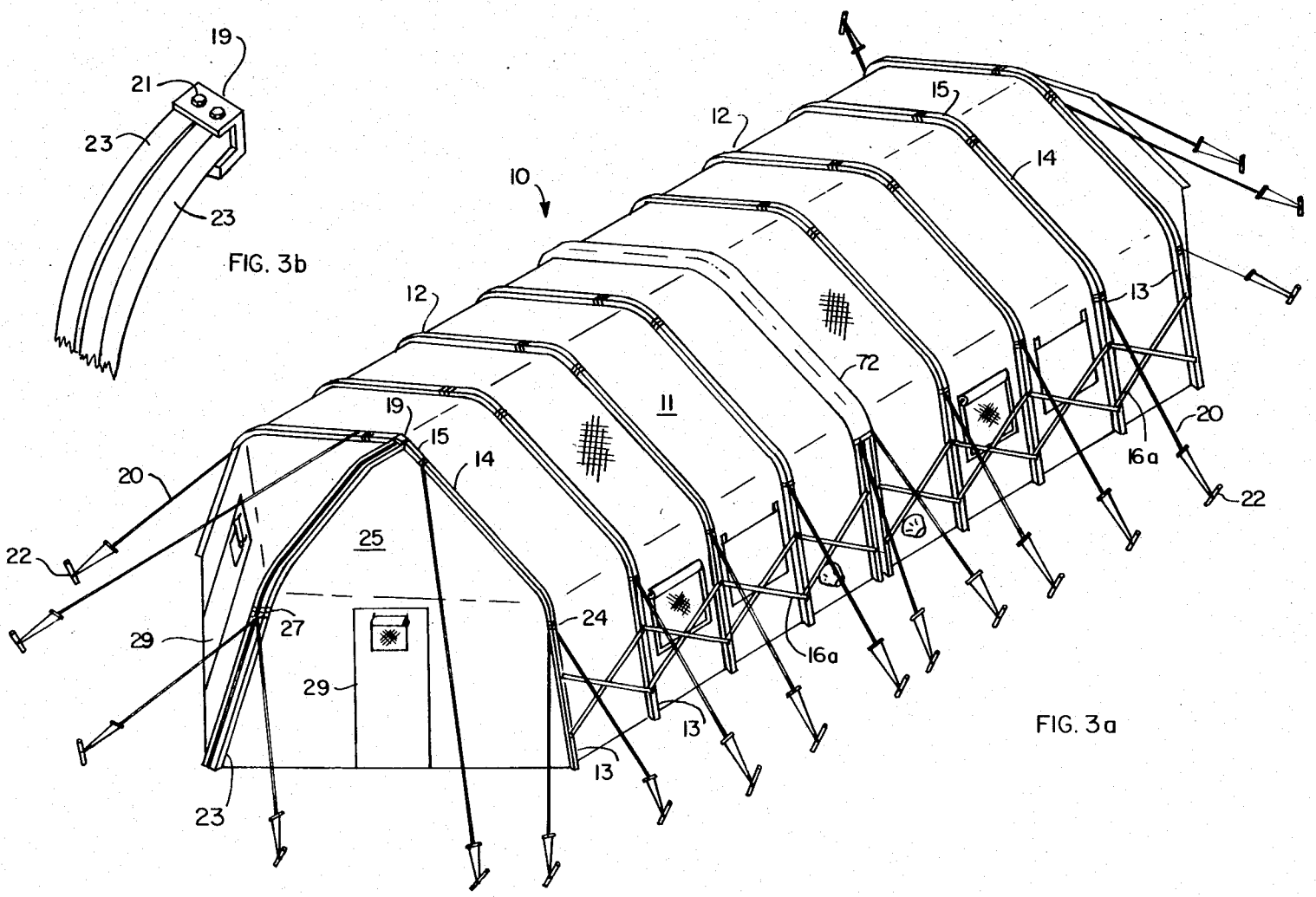
FIG. 3*a* is a pictorial illustration of an alternative embodiment of the invention equipped with a triangular vestibule one each end.
FIG. 3*b* is an elevational view showing details of the pivot for the shelter vestibule in erected position.
Figures 3C, 3D:
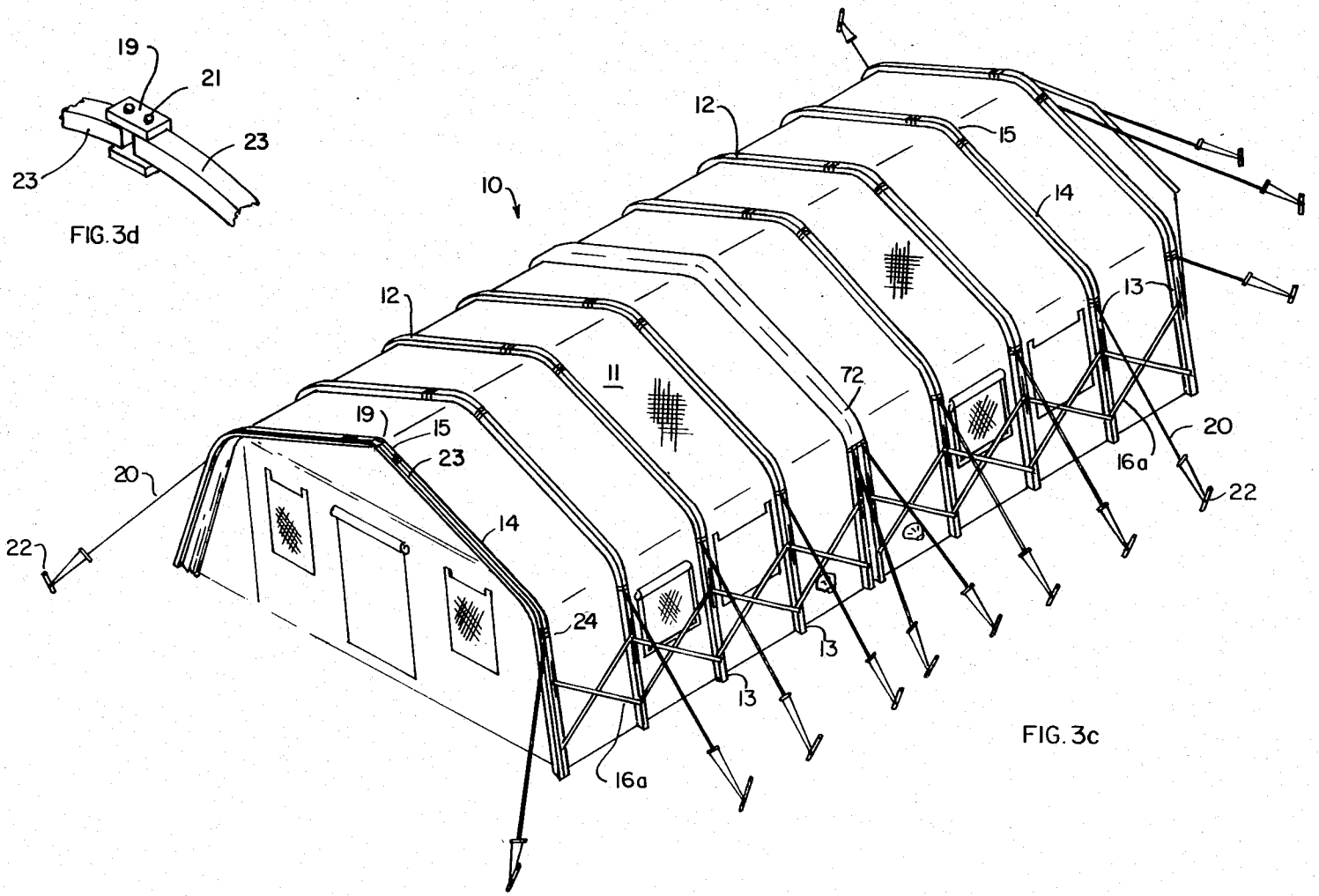
FIG. 3*c* is a pictorial illustration of the alternative embodiment of the invention shown in FIG. 3*a* with the triangular vestibule folded flat against the end of the shelter.
FIG. 3*d* is an elevational view showing details of the pivot for the shelter vestibule in the folded position.

FIG. 1 shows a preferred embodiment of the present invention, wherein a soft side shelter 10 comprises a durable fabric cover 11 and a plurality of channel-shaped rib members 12 constructed of a suitable lightweight, relatively high strength material, such as various aluminum alloys. Rib members 12 are in the preferred embodiment, rectangular in cross section for purposes of strength. However, it is to be understood that any suitable shape can be employed to meet specific requirements or conditions. Each rib 12, in the preferred embodiment, comprises two leg members 13, two arm members 14, and one top ridge member 15. Rib members 12 are equidistantly disposed longitudinally in a column. Adjacent rib members are interconnected and spaced on each side of the shelter by single reinforcing members 16 or by X-shaped reinforcing members or braces 16*a* as shown in FIGS. 3*a* and 3*c*.

Eave extenders 17, shown in FIGS. 1 and 2, are installed at several points along the top of ribs 12 in order that a fly cover 18 may be added quickly to the top of the shelter when desired. Fly cover 18 is guyed by guy ropes 20, which are attached to stakes 22.

The embodiment of the invention depicted in FIG. 1, while it is an excellent and useful portable shelter, may be further improved. As is obvious to those skilled in the art, the large flat ends of this embodiment of the shelter cause considerable wind resistance, especially in very high winds. To alleviate this condition and to improve the wind resistance characteristics of the shelter, a wind deflecting element was needed. FIG. 3*a* shows a further improved version of the shelter of FIG. 1 having a triangular vestibule 25 added at either end. Vestibule rib members 23 are pivoted at the top of the ridge member 15 located at the end of shelter 10. FIG. 3*b* shows the U-shaped vestibule pivot 19 having pivot pins 21 which hold vestibule rib members 23. As may be seen in FIG. 3*a*, pivot 19 is attached directly to the top of ridge member 15. FIG. 3*c* shows the vestibule in folded position. FIG. 3*d* shows details of pivot 19 in folded position. Thus, FIGS. 3*a* to 3*d* disclose a vestibule 25 having two swinging triangular-shaped halves which fold out and latch to make the shelter more wind resistant, yet can fold up compactly with the rest of the shelter. As shown in FIGS. 3*a* and 3*c*, side reinforcing members may be the X-shaped members 16*a* or they may be the single reinforcing members 16 as shown in FIG. 1. Whether the reinforcing members are the X-shaped type or the single-member type, they are preferably fabricated of aluminum, steel, or fiberglass pultrusions.

In addition to the improvement in wind resistance discussed above for the modified shelter of FIGS. 3*a–d*, the vestibule makes the shelter ideal for use under black-out conditions. A person entering the vestibule may close the vestibule door before opening the inner door, thus insuring that no light from the shelter may be seen outside.

As may be seen in FIG. 3*a*, a latch 27 is provided to hold vestibule rib members 23 in the erected position. Vestibule doors 29 may be either soft fabric or may be hard wall doors attached by hinges or by pile fastener tape, as will be disclosed in more detail below.

Figure 4:
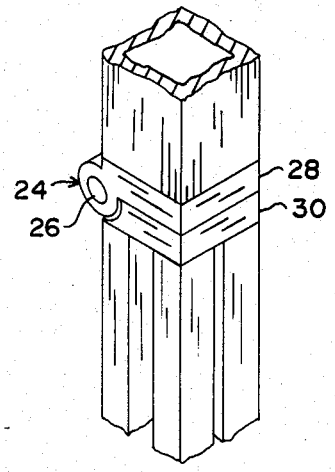
FIG. 4 is an elevational view of the cast hinge of the invention in the closed position.
Figure 5:
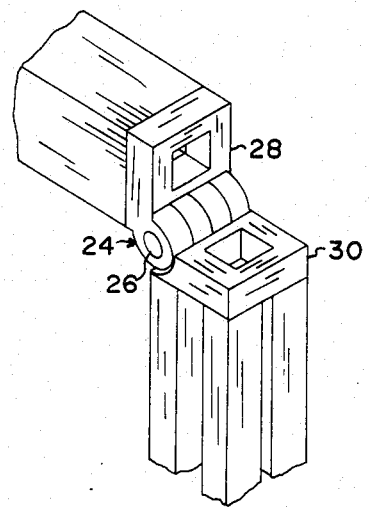
FIG. 5 is an elevational view of the cast hinge of FIG. 4 in the open position.

FIGS. 4 and 5 depict the aluminum cast hinge 24. This is a simple yet exceptionally sturdy hinge which allows very rapid and non-interruptive set-up for the shelter. In the preferred embodiment of the invention, ribs 12 (see FIG. 1) are hinged between the top member 15 and each arm member 14 as well as between each arm member 14 and the adjacent leg member 13. Thus, in the preferred embodiment, each rib member 12 has a total of four hinges 24.

Looking again at FIGS. 4 and 5, hinge 24 has a hinge pin 26 and two hinge leaves 28 and 30, which are identical. One casting functions to make both hinge leaves, thus eliminating left and right hand parts. As may be seen in FIG. 5, each hinge leaf has two substantially circular spaced projections attached to the leaf at an obtuse angle. Each projection has a circular opening to receive hinge pin 26. The projections of the two leaves together provide for aligned bearing surfaces to receive hinge pin 26.

Rib members 12 may also be equipped with an alternative type of hinges 30 which are on each side of the top of the ridge members and on each side of the arm members. As may be seen in FIGS. 6, 7, and 8, alternative hinges 30 are simple, rugged, and relatively foolproof. A section of extruded aluminum 32 having a square cross section fits into U-shaped hinge cover 34 and is pivoted around flat head bolt 36. The hinge can be latched by pivoting section 32 into hinge cover 34 and then moving slide latch 38 down both channels 40 in section 32 and channel 42 in hinge cover 34. Hinge 30 may be seen in the latched and unlatched configurations in FIGS. 6 and 7, respectively. FIG. 8 shows a latched hinge 30 with a portion of section 32 cut away to show the hinge in cross section. As shown in FIG. 6, slide 38 has an I-shaped cross section.

Looking now at FIG. 9, the elevational view of rib 12 shows how reinforcing members 16 are attached to ribs 12. Each reinforcing member 16 connects and spaces two adjacent ribs 12, one end of each reinforcing member 16 being pivoted from pin 44 through a fixed point on one rib and slidably connected to the adjacent rib 12. Pin 44 holds one end of each reinforcing member 16 in a fixed position in channel 46. FIG. 9 also shows how the movable end of each reinforcing member 16 is fastened to rib 12 by means of slide 48 moving vertically in channel 50.

As FIG. 9 also shows, shelter fabric section or panel 52 is connected to ribs 12 through beads 54 of polyester cord which slide into channels 56 in ribs 12. Fabric cover 11 (see FIG. 1) comprises a plurality of individual fabric sections or panels 52. Beads 54 allow the fabric section 52 to be removed from ribs 12 quickly and easily for repair or replacement and constitute a considerable improvement over riveting or other more permanent means of attachment of the fabric. In order to make the extruded aluminum sections of ribs 12 more versatile and usable on either side of the structure, ribs 12 are designed with double channels 56 on both sides of the ribs 12.

Figure 10:
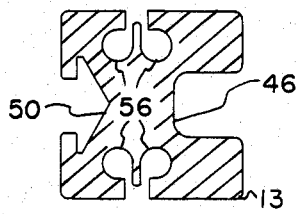
FIG. 10 is a cross-sectional view of an aluminum alloy extrusion of the type used in the leg section of the ribs of the invention.
Figure 11:
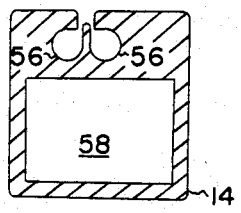
FIG. 11 is a cross-sectional view of an aluminum extrusion of the type used in the arm and top sections of the ribs of the invention.

FIGS. 10 and 11 show the cross-sectional areas of two types of aluminum extrusions used for ribs in the shelter. FIG. 10 shows the type of extrusion used in the legs 13 (FIGS. 1 and 3). As may also be seen in FIG. 9, this extrusion is equipped with a channel 46 which receives the fixed end of reinforcing members 16 and a channel 50 which receives slide 48 attached to the other end of reinforcing members 16. The two remaining sides of the extrusions each have double channels 56 for receiving polyester cord beads 54 which are each attached to one piece of the shelter fabric section 52.

FIG. 11 shows the type of extrusion used in the arms 14 and ridge members 15. This extrusion has double channels 56 on one side for receiving beads 54 and is closed on the other side with the hollow portion 58 inside to reduce the weight of the extrusion.

Figure 12:
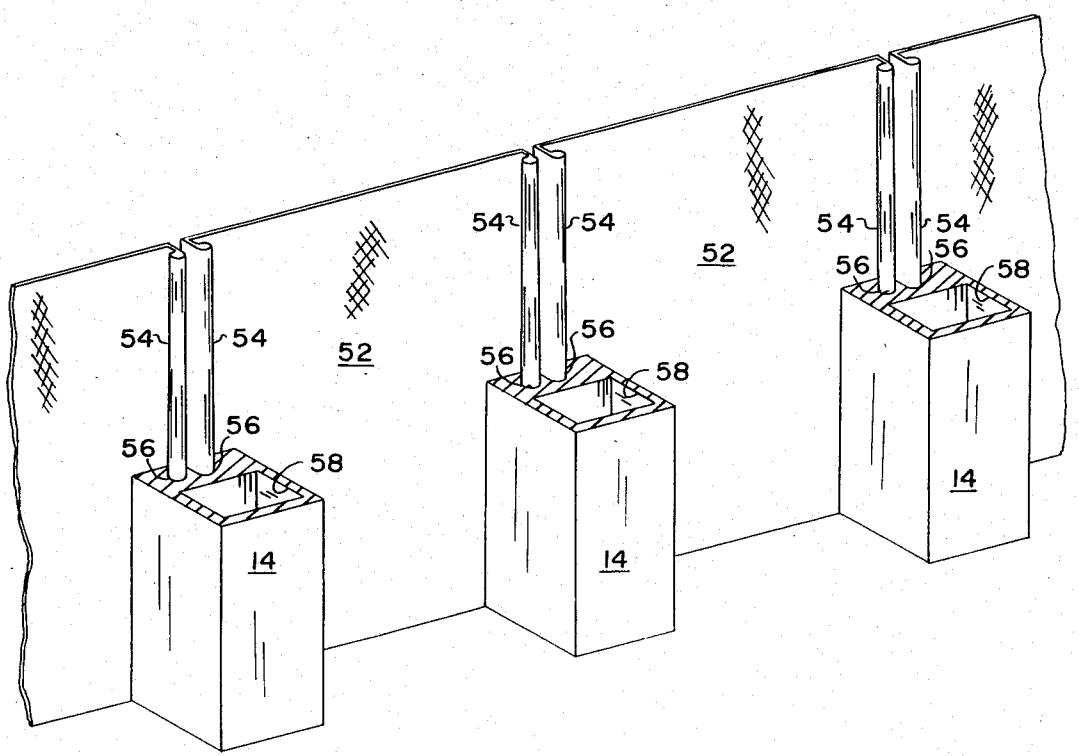
FIG. 12 is an elevational view showing how adjacent fabric panels are attached to adjacent ribs.

FIG. 12 shows several adjacent ribs utilizing the type of extrusion shown in FIG. 11. This drawing illustrates that adjacent panels of fabric 52 can easily be attached or detached individually or all together for repair or replacement.

Figures 13, 14:
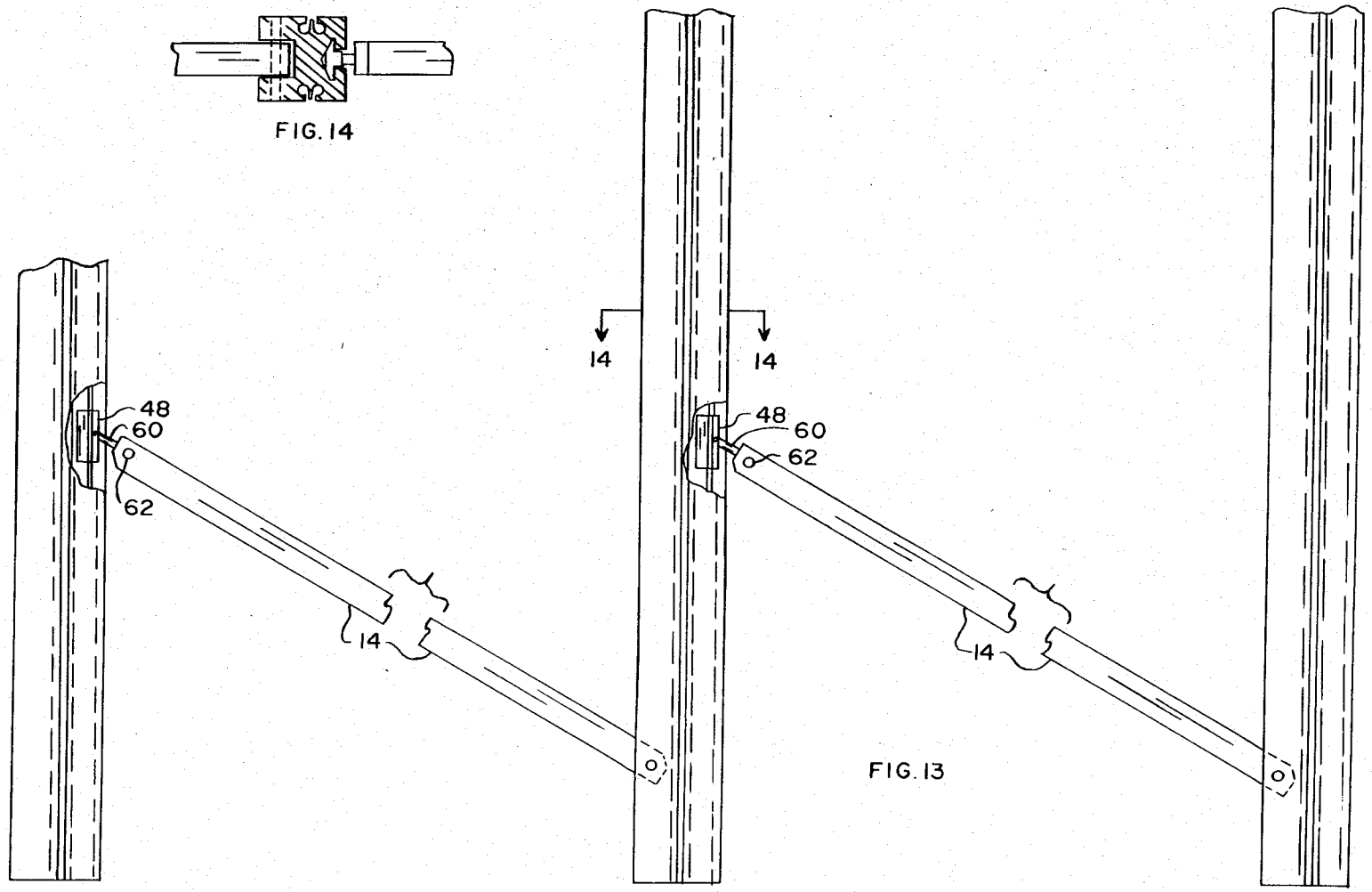
FIG. 13 is a side elevational view of the ribs and reinforcing members in partially extended configuration, shown partially in section.
FIG. 14 is a sectional view of the aluminum extrusion ribs taken along line 14—14 of FIG. 13.
Figure 16:
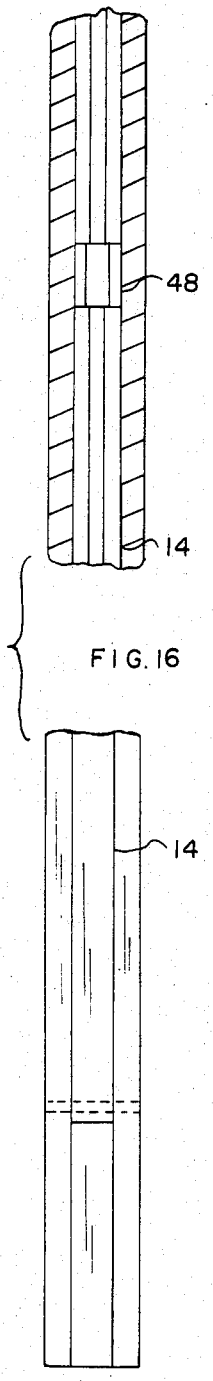
FIG. 16 is a sectional view of a rib of the framework taken along line 16—16 of FIG. 15.
Figure 15:
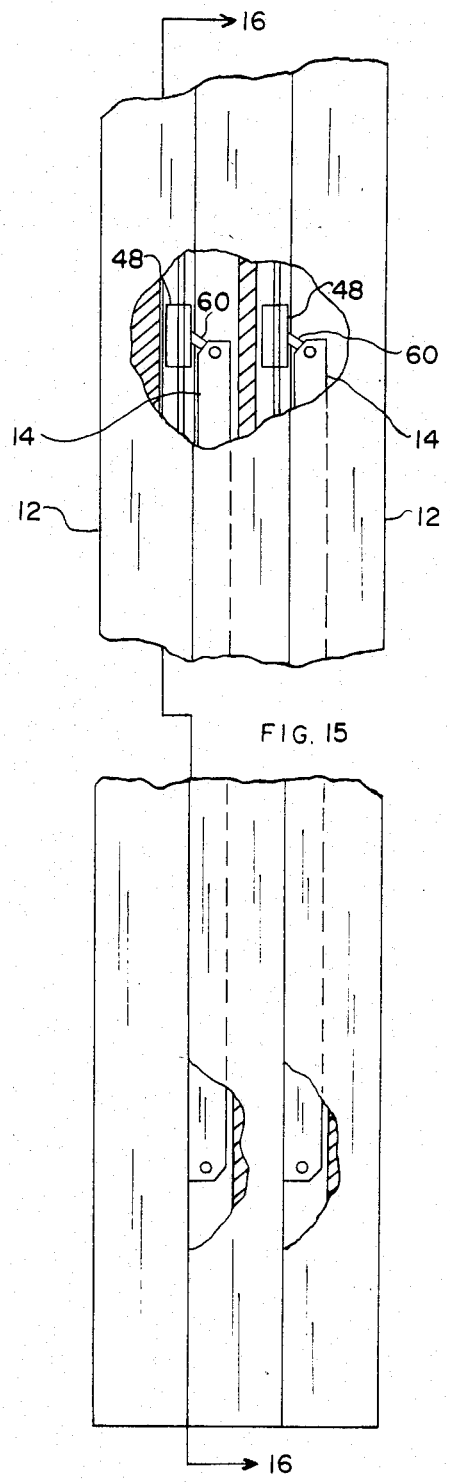
FIG. 15 is a side elevational view of the ribs and reinforcing members in closed configuration, shown partially in section.

Reinforcing members 16 are shown in greater detail in FIGS. 13 and 14. In these figures which show the reinforcing members 16 in the extended position, it may be seen that members 16 are pivoted from slides 48 and threaded stud 60 about pivot pin 62. FIGS. 15 and 16 show how ribs 12 abut each other when shelter 10 is in a folded position. In FIG. 15, it may be seen that when shelter 10 is folded, the long axis of reinforcing members 16 is substantially vertical and makes about a 60 degree angle with threaded stud 60.

Looking now at FIGS. 17 and 18, shelter connector 64 was designed to solve the problem of securely connecting two shelters together after erection. This connector allows several shelters to be connected together with the end-to-end connectors, eliminating a gap between the shelters. Shelter connector 64 is a U-shaped member having a portion 66 threaded on one side to receive a nut 68. Eight shelter connectors 64 are used to attach adjacent shelters 10 which are butted together end to end. Four of the connectors are attached to the end rib of one shelter and latch into position over the top of the end rib on the second shelter. Conversely, four more connectors are attached to the end rib of the second shelter and latch to the end rib of the first shelter. A total of four connectors are located on the ridge members, and four more connectors are located lower down on the arm members. A weather seal 70 makes the connection moisture-proof. A joint cover 72 (see FIG. 1) may also be used for additional protection.

FIGS. 19–26 illustrate how various accessories of the shelters, such as screens, grommets, zippers, and hook and pile fasteners, are heat-sealed to the shelter using a dielectric process. FIGS. 19 and 20 show how screens are installed into the fabric panels. FIGS. 21 and 22 illustrate grommet installation. FIGS. 23 and 24 illustrate zipper installation. FIGS. 25 and 26 illustrate hook and pile installation.

Figure 28:
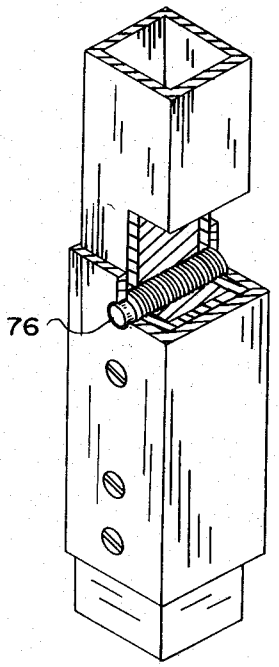
FIG. 28 is an elevational view showing the alternative hinge of FIG. 23 partially in section and in latched position.
Figure 27:
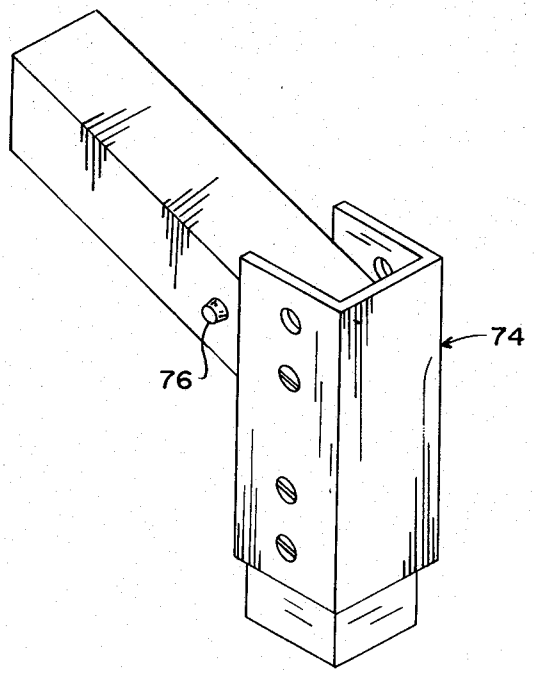
FIG. 27 is an elevational view of an alternative hinge using a spring plunger shown in folded position.

An alternative arrangement for cast hinges 24 is shown in FIGS. 27 and 28. Alternative hinge 74 uses a spring loaded plunger or detent 76 as a latch.

Figure 30:
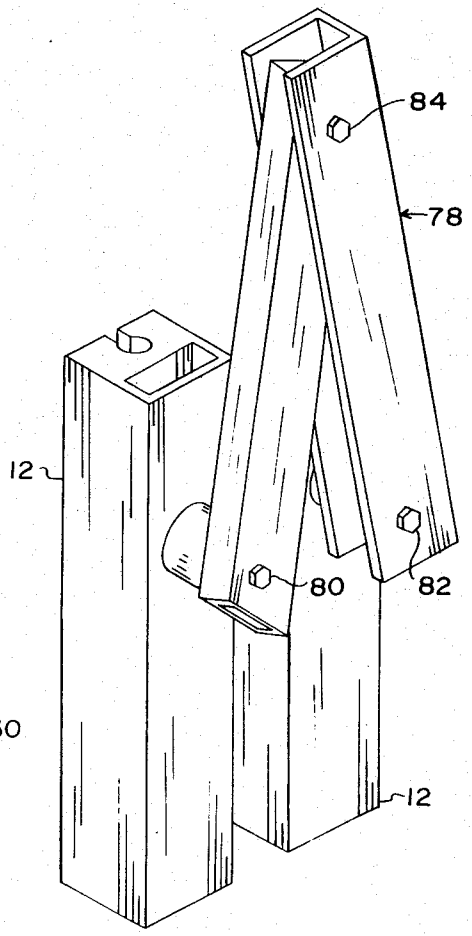
FIG. 30 is an elevational view of the alternative reinforcing member of FIG. 29 in unlocked (folded) position.
Figure 29:
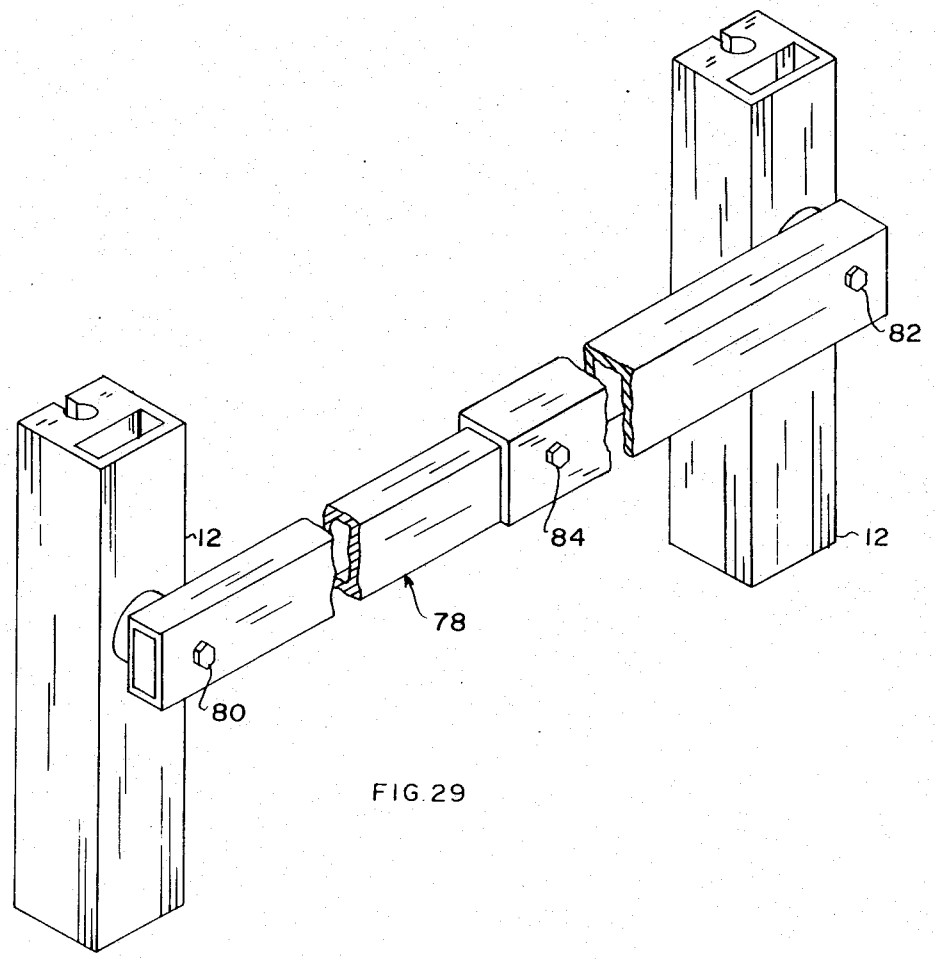
FIG. 29 is an elevational view of an alternative reinforcing member in locked (extended) position.

An alternative arrangement for reinforcing members 16 is shown in FIGS. 29 and 30. Reinforcing member 78 is fixed at both of its ends at pivot points 80 and 82. Member 78 is also pivoted in its center at pivot 84 and will fold about pivot 84 when shelter 10 is compressed or closed.

Figure 31:
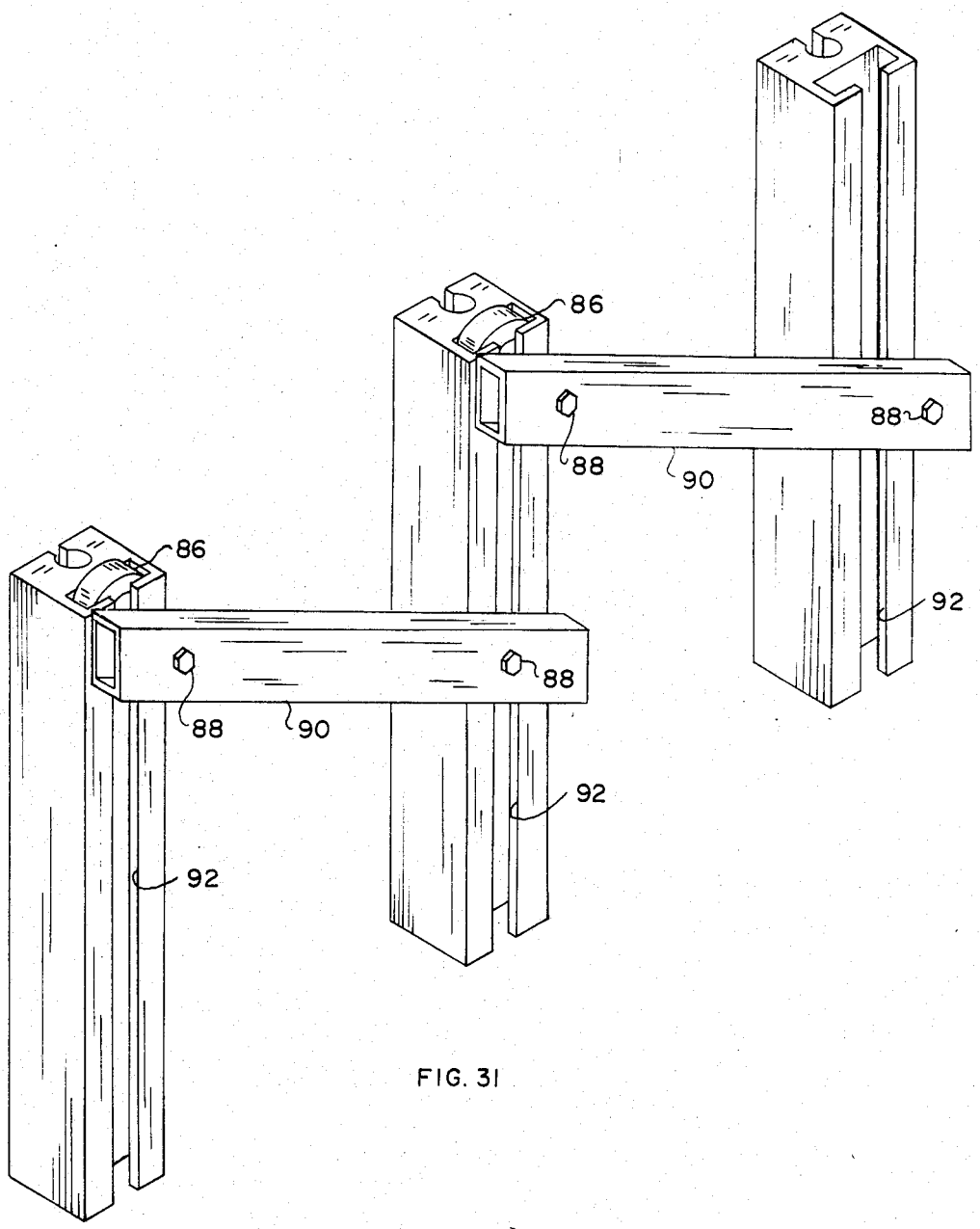
FIG. 31 is an elevational view showing an alternative arrangement for reinforcing members utilizing a roller bar assembly.

FIG. 31 depicts a roller bar assembly which may be used as an alternative to the arrangement previously shown with the preferred embodiment in FIGS. 13 and 14 and is designated by slide 48 attached to threaded stud 60. Roller 86 is attached by bolt 88 to alternate reinforcing member 90. Roller 86 rolls in channel 92.

FIGS. 32–40 inclusive show details of the frame of a small embodiment of shelter 10 (FIGS. 1, 3*a*, and 3*c*). Looking first at FIG. 32, there is shown a frame 101 for the small (20 feet ×11 feet) embodiment of the invention designated generally by the numeral 100 and having six ribs 102 and five X-shaped braces 104 connecting each adjacent pair of ribs 102. Ribs 102 on this small shelter 100 comprise an arch 106 attached by hinges 110 at each of its ends to a leg 108. Thus, arch 106 on this small embodiment of the shelter 100 corresponds to a ridge member 15 and two arms 14 on the larger embodiments of the shelter 10, and legs 108 on this shelter 100 correspond to legs 13 on shelter 10. Each X-brace 104 comprises two crossed elongated members, an inner member 104*a* which is close to legs 108 and an outer member 104*b* which is outside the inner member 104*a* and therefor spaced further from legs 108. The crossed members 104*a* and 104*b* are pivotally connected together at their midpoints 112. The lower end of each crosssed member 104*a* and 104*b* is pivotally connected to the lower part of one leg 108, with its upper end movably connected to the upper end of a next adjacent leg 108. Thus, each pair of X-shaped braces 104 is operative to push the ribs 102 together in abutting relationship when the shelter 100 is closed (compressed) and to push them apart in spaced relationship when the shelter 100 is opened (extended).

Figure 33:
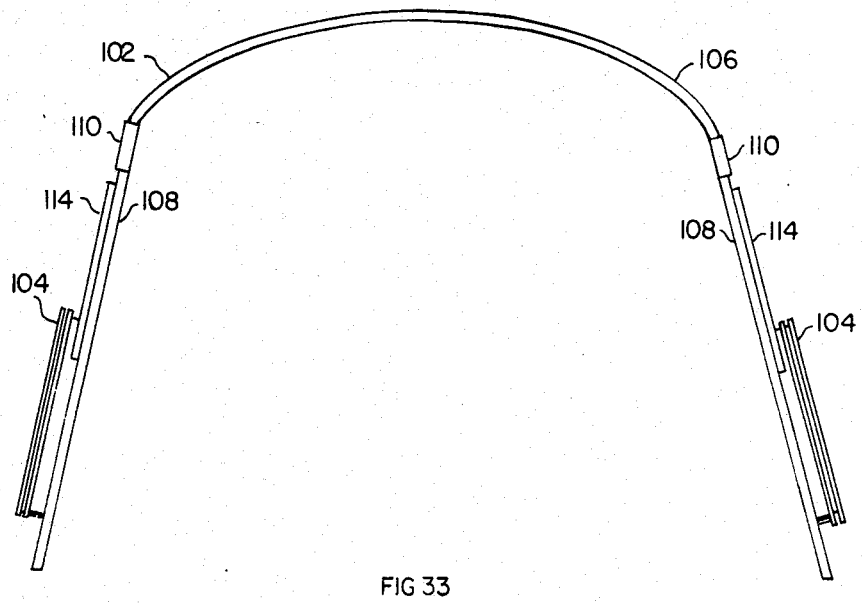
FIG. 33 is an end view of the small embodiment of the invention shown in FIG. 32.

FIG. 33 is an end view of frame 101 of small shelter 100. One rib 102 comprising arch 106, two legs 108, and two hinges 110 may be seen. X-shaped cross braces 104 are mounted on legs 108. In this view it may be clearly seen that long sections of channel 114 are attached directly to legs 108 and the upper ends of members **104*a* and 104*b* are in turn movably attached to channel 114**.

Figure 34:
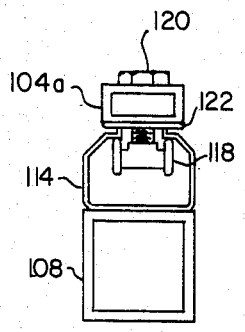
FIG. 34 is a cross-sectional view of the mount for the top end of an inner elongated member of an X-shaped brace connecting an end rib and its adjacent rib.

FIGS. 34–39 inclusive show cross-sectional views of several kinds of mounts used to attach X-braces 104 to legs 108 of ribs 102. FIG. 34 shows the mount, located at point 116 (FIG. 32), which supports the upper end of inner X-brace member **104*a*. Member 104*a* is rollably attached to slotted channel 114 which is attached to leg 108. Roller assembly 118 is firmly attached to member 104*a* with stud 120, thus allowing the upper end member 104*a* to move downward when frame 101 of shelter 100 is open (extended) and to move upward when frame 101 is closed (compressed). Spacer 122 between member 104*a* and channel 114 reduces friction between moving parts and protects the edges of the open slot in channel 114**.

Figure 35:
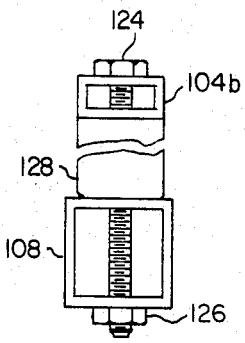
FIG. 35 is a cross-sectional view of the mount for the bottom end of an outer elongated member of an X-shaped brace connecting an end rib and its adjacent rib.

FIG. 35 shows the mount, located at point 118 (FIG. 32), which supports the lower end of outer X-brace member **104*b*. Member 104*b* is rotatably attached to leg 108 with bolt 124 and nut 126. A thick spacer 128 separates outer member 104*b* from leg 108 and holds member 104*b* the proper distance above leg 108**.

Figure 32:
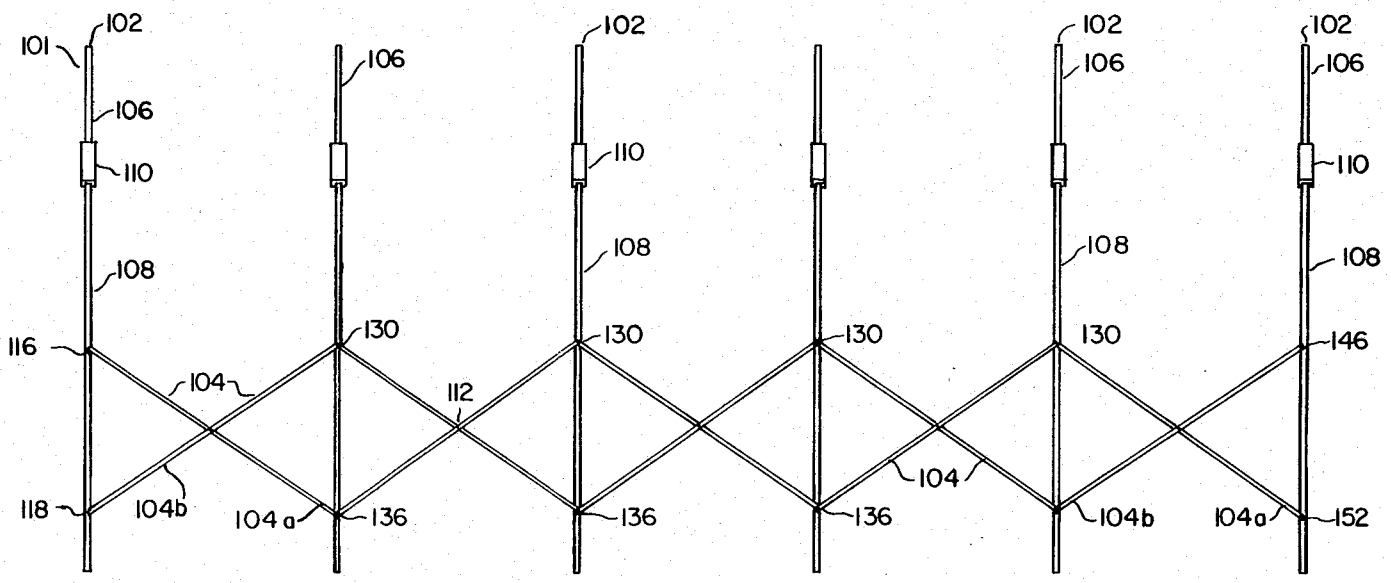
FIG. 32 is a side view of the framework for a small embodiment of the invention.
Figure 36:
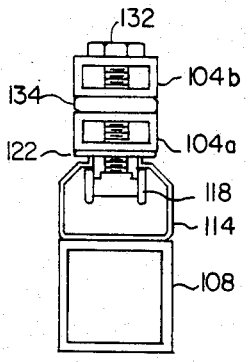
FIG. 36 is a cross-sectional view of the mount for the top ends of two elongated members of adjacent X-shaped braces, attached to an inner rib.

FIG. 36 shows the mount located at four points 130 (FIG. 32). This type mount supports the upper end of all the X-brace members, both **104*a* and 104*b*, which are attached to the four ribs 102 which are not on the ends of shelter 100. The mount of FIG. 36 is similar to the mount of FIG. 34 except that the top end of outer member 104*b*, as well as inner member 104*a*, is rollably attached to channel 114. Stud 132 fastens members 104*a* and 104*b* to roller assembly 118. As shown in FIG. 34, channel 114 is attached by a suitable method such as welding, to leg 108. Spacers 112 and 134** reduce friction and improve stability at pivot points.

Figure 37:
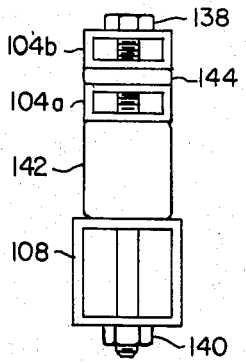
FIG. 37 is a cross-sectional view of the mount for the lower ends of two elongated members of adjacent X-shaped braces, attached to an inner rib.

FIG. 37 shows the mount located at four points 136 (FIG. 32). This type mount supports the lower ends of all the X-brace members, both **104*a* and 104*b*, which are attached to the four ribs 102 which are not on the ends of shelter 100. The mount of FIG. 37 is similar to the mount of FIG. 35 except that the bottom end of inner member 104*a*, as well as the bottom end of outer member 104*b*, is rotatably attached by bolt and nut 138 and 140 to leg 108. Spacer 142 holds members 104*a* and 104*b* the proper distance away from leg 108. Spacer 144 reduces friction at the pivot point between members 104*a* and 104*b***.

Figure 38:
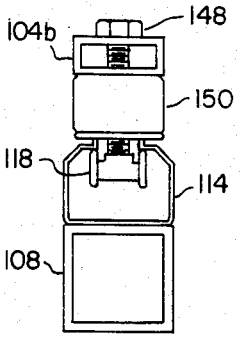
FIG. 38 is a cross-sectional view of the mount for the top end of an outer elongated member of an X-shaped brace connecting an end rib and its adjacent rib.

FIG. 38 shows the mount, located at point 146 (FIG. 32), which supports the upper end of outer X-brace member **104*b*. Member 104*b* is rollably attached to channel 114, which is attached to leg 108. Stud 148 holds member 104*b* attached to roller assembly 118. Spacer 150 holds member 104*b* the proper distance from channel 114 and leg 108**.

Figure 39:
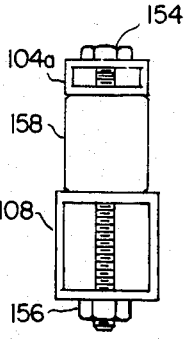
FIG. 39 is a cross-sectional view of the mount for the bottom end of an inner elongated member of an X-shaped brace connecting an end rib and its adjacent rib.

FIG. 39 shows the mount, located at point 152 (FIG. 32), which supports the lower end of inner X-brace member **104*a*. Member 104*a* is rotatably attached to leg 108 by bolt 154 and nut 156. A thick spacer 158 separates inner member 104*a* and leg 108 and holds member 104*a* the proper distance above leg 108**.

Figure 40:
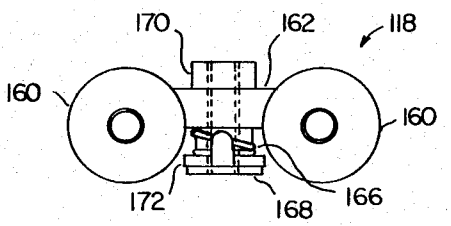
FIG. 40 is a side elevation view of a roller assembly for movably attaching the upper ends of the members of the X-shaped braces to the ribs.

FIG. 40 shows a side elevation view of the roller assembly 118 for rollably attaching the upper ends of X-braces **104*a* and 104*b* to the shelter ribs 102. End views of this assembly are shown in FIG. 34, FIG. 36, and FIG. 38. Roller assembly 118 has four wheels 160 attached to chassis 162. A spring-loaded vertical member 164 runs up through chassis 162 and is tapped out on the inside to receive a stud, such as 120 (FIG. 34), 132 (FIG. 36), or 148 (FIG. 38), all described above. Spring 166 is mounted on member 164 and is held in place by flange 168, which is part of member 164. Spacer 170 is mounted on the top part of member 164, while spacer 172 is mounted on the bottom part of member 164, above flange 168**.

Figure 42:
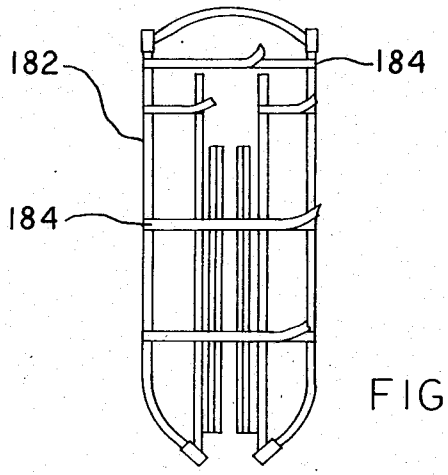
FIG. 42 is a plan view of the folded half-shelter lying on its side and held by webbing straps in position for packing.
Figure 43C:
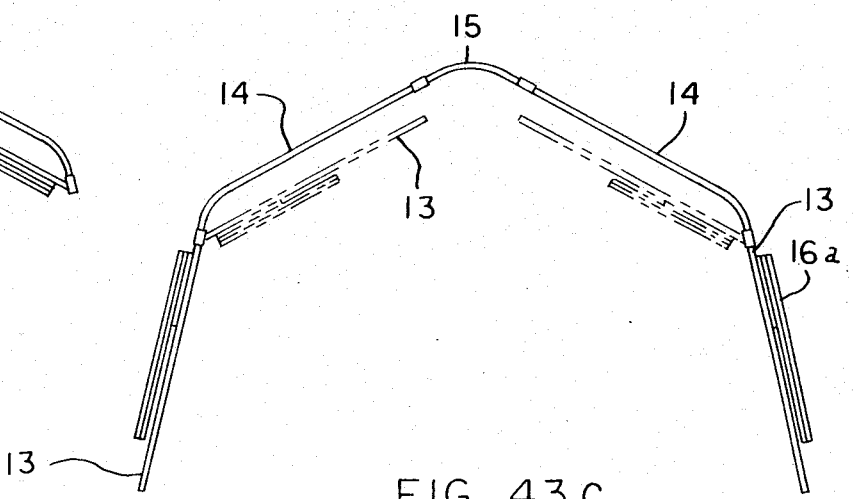
FIG. 43*c* is a plan view of the half-shelter lying on its side with both arms and legs unfolded to the fully extended position.
Figure 41:
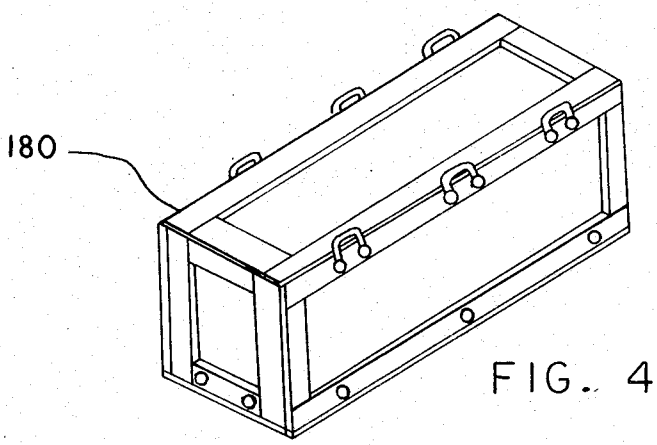
FIG. 41 is a perspective view of a shipping container accommodating a half-shelter for a large embodiment of the invention.

FIGS. 41–46 inclusive illustrate the steps in the method of erecting a large or medium sized shelter 10. FIG. 41 illustrates a shipping container 180 which houses a first half-shelter 182 in its packed configuration. This container 180 is opened and the folded half-shelter 182 removed. As shown in FIG. 42, the webbing straps 184 are removed from the half-shelter by depressing the buckle clamps and pulling the straps free. With the folded shelter 10 as shown in FIG. **43*a*, the shelter arms 14 are unfolded to the full extended position, as shown in FIG. 43*b*. Next the shelter legs 13 are unfolded to the full extended position, as shown in FIG. 43*c***.

Figure 44:
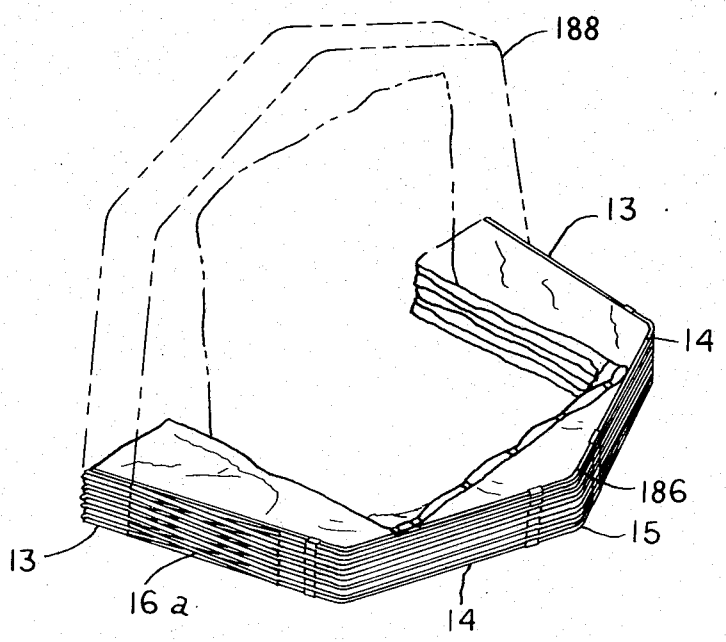
FIG. 44 is a perspective view of the half-shelter lying on its side with both arms and legs fully extended and ready to raise to the standing position.

As illustrated in FIG. 44, to raise the half-shelter, attach two of the longest guy lines to snap attachments located on the ridge member 15. With at least one person securing the guy ropes and at least one person on each side of the shelter frame, grasp the assembly above and below the lower hinge points. Then raise the shelter to a standing position, as shown in phantom at 188. At this time, start a short extension (18 to 24 inches) to stabilize the upright position.

Figure 45:
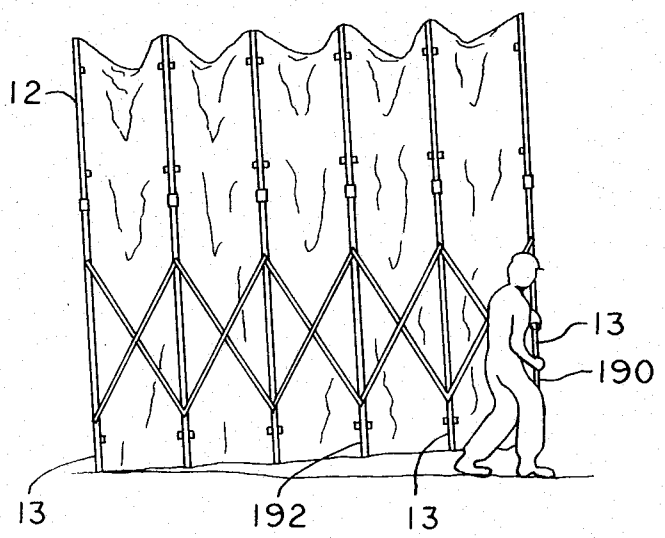
FIG. 45 is a side elevation of the standing half-shelter, shown being extended by at least one person on either side.

To extend the half-shelter 182 as shown in FIG. 45, two persons should be positioned on each side, one opposite the front leg 190 and one opposite the third leg 192. They should grasp the shelter legs 190 and 192 approximately 3 feet from the ground. Then lift and tilt the entire frame assembly back so that the legs 13 of only the rear rib 12 are touching the ground. Then, all together, all four persons should walk forward until the shelter is fully extended, being conscious that binding will result if one side is extended faster than the other.

Figure 43B:
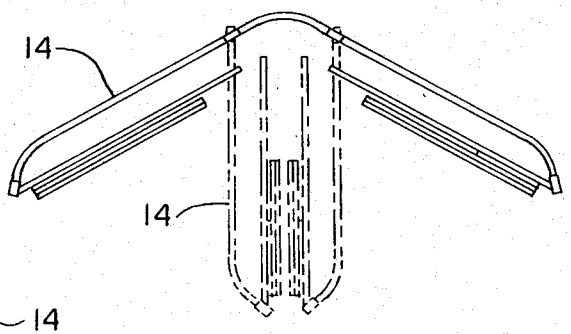
FIG. 43*b* is a plan view of the partially folded half-shelter lying on its side with the arms unfolded.
Figure 43A:
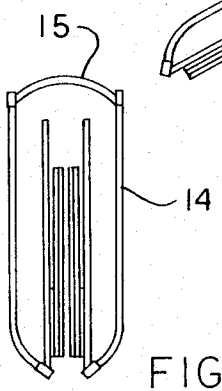
FIG. 43*a* is a plan view of the folded half-shelter of FIG. 42 with the webbing straps removed.
Figure 46:
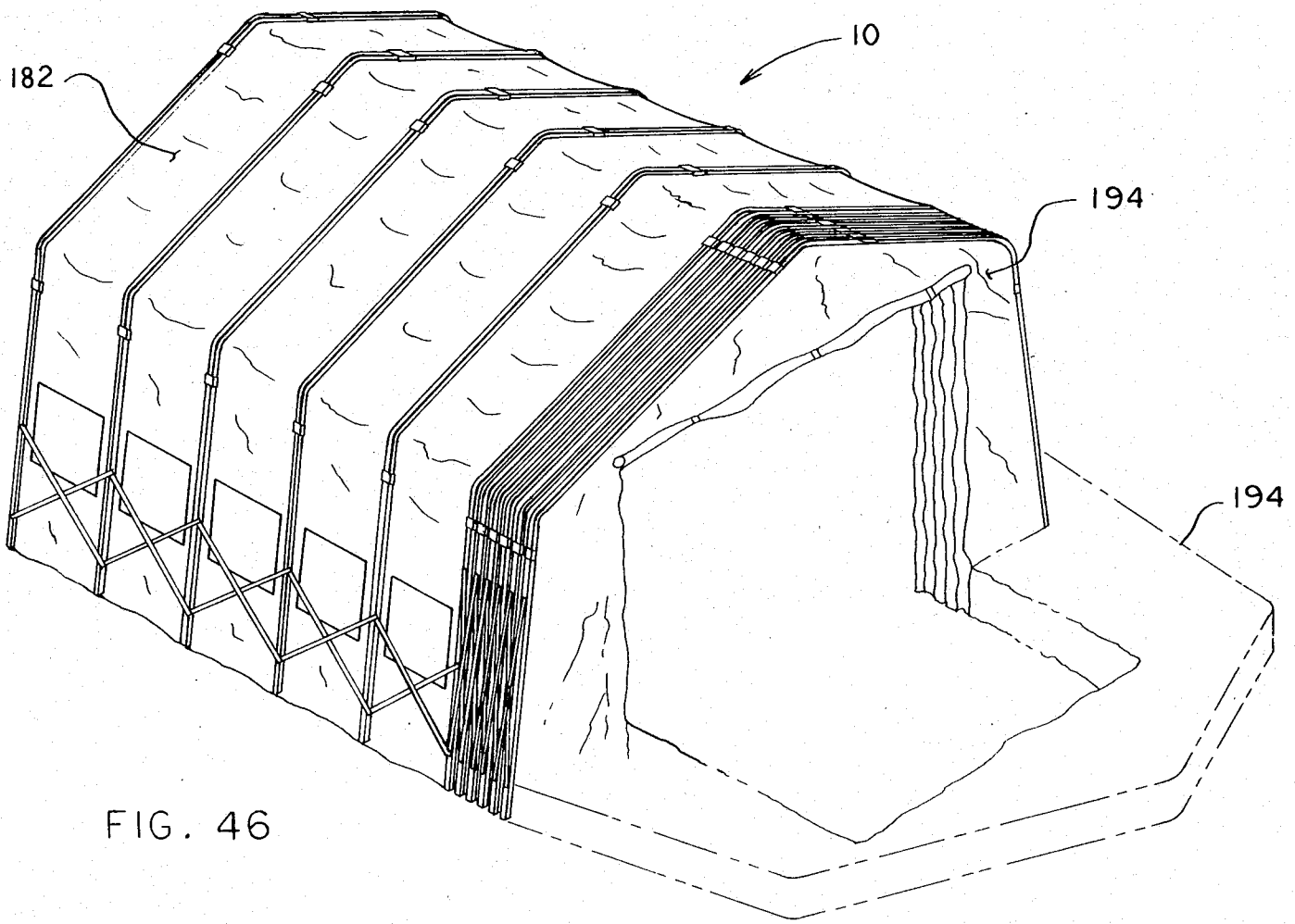
FIG. 46 shows a perspective view of one half-shelter in the fully extended position and a second half-shelter in standing position and attached to the first half-shelter, ready to be extended.

As shown in FIG. 46, the second (mating) half-shelter 194 is prepared by repeating the procedure illustrated in FIGS. 41, 42, and 43. The legs of the mating half-shelter should be positioned about 3 feet from the front leg of the extended half-shelter (as shown in phantom) so as to cause no restriction when the mating half-shelter 194 is raised. The mating half-shelter 194 is then raised as illustrated in FIG. 44 and fully extended as illustrated in FIG. 45. The two halves 182 and 194 of the shelter 10 are then latched together with shelter connectors 64 and weather seal 70, as illustrated in FIGS. 17 and 18, and covered with a joint cover 72 (see FIG. 1). Lastly, shelter 10 is staked down with guy ropes 20 and stakes 22 as shown in FIG. 1. To strike the shelter, the above described procedures are reversed.

Figure 47:
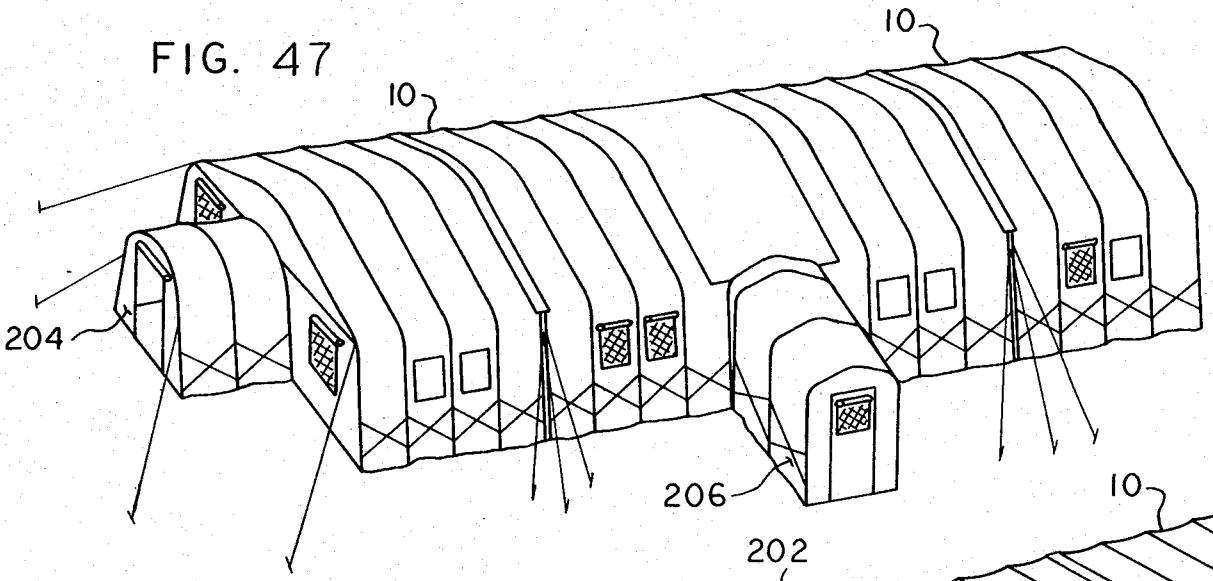
FIG. 47 is a perspective view showing two large or medium sized shelters connected together with an end-to-end connector and equipped with a vestibule on one end and one side.

To erect and operate a small shelter 100 (see FIG. 47) is similar but even simpler than described above for a large-sized shelter 10. The shelter 100 is carried or transported in the folded position in a zipper carrying bag (not shown). In this configuration, the shelter makes a surprisingly compact and easy to handle semicircular package. To erect the shelter, the zipper bag is removed and the shelter 100 laid flat on the ground. The shelter legs are then extended into place. Next, the shelter is raised to the vertical position ready for extension. Then, two men grasp the shelter, one on either side, and simply walk it out to its fully extended position. Lastly, guy ropes along the sides and ends of the shelter are staked down. The whole procedure takes five minutes or less for a small shelter 20 feet long and 11 feet wide. By contrast, a medium sized shelter about 32 feet long and 20 feet wide may be deployed or struck in ten minutes by four persons. A large maintenance shelter 42 feet long and 22 feet wide may be deployed or struck in fifteen minutes by six persons.

Large or medium sized shelters 10 have been shown thus far in this application as single free-standing shelters. However, as will be explained, the invention also includes a method and arrangement for connecting a plurality of shelters 10 together into groups of shelters or shelter complexes which may comprise any practical number of shelters 10. Looking now at FIG. 47, two shelters 10 may be erected and positioned in a row 200 so that they may be connected by an end-to-end connector 202. Row 200 has also a vestibule 204 connected at one end and a vestibule 206 connected to the side of end-to-end connector 202. Vestibules 204 and 206 prevent rain from entering the shelter 10 and, as previously explained for the triangular vestibules shown in FIGS. 3 to *3d*, the vestibules make the shelter usable under blackout conditions. A person entering the vestibule 204 or 206 may close the outer door before opening the inner door, thus preventing any light from escaping from the shelter.

Figure 48:
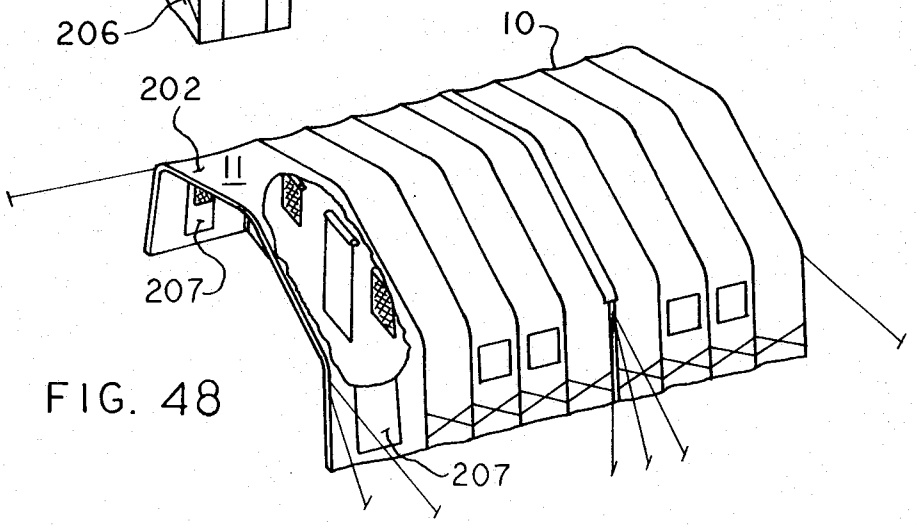
FIG. 48 is a perspective view of a large or medium sized shelter with an end-to-end connector on one of its ends.

FIG. 48 shows a shelter 10 with an end-to-end connector 202 attached to one of its ends. Connector 202 has two ribs 12 of the types used in shelter 10 and a single panel of fabric 11 attached to its ribs 12. As may be seen, connector 202 has no ends but does have two doors 207, one on either side. Connector 202 is attached to the end of shelter 10 by use of a plurality of shelter connectors 64 (see FIGS. 17 and 18).

Figure 49:
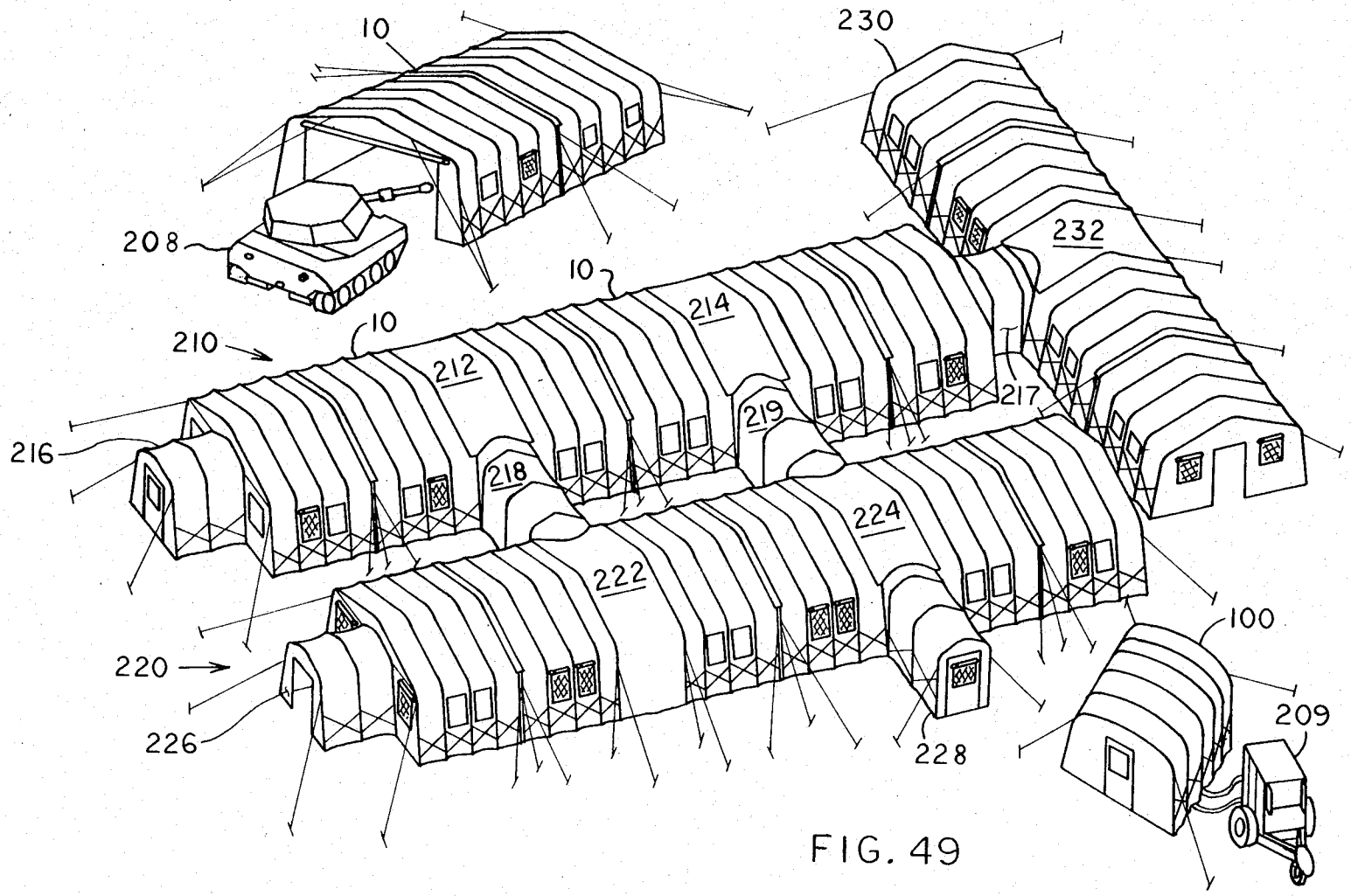
FIG. 49 is a perspective view showing how a plurality of large or medium sized shelters can be arranged in a large connected complex.

FIG. 49 shows how large or medium sized shelters 10 can be arranged in a large connected complex suitable for a large field hospital or a high level military headquarters. At the upper left, a large shelter 10 is shown being used as a maintenance shelter for a tracked vehicle 208. As shown in the lower right, a small sized shelter 100, connected to a generator 209 may be used as a small personnel quarters or as an operations type shelter.

The large complex in FIG. 49 has three shelters 10 aligned in a first row 210 with their mating ends connected together by two end-to-end connectors 212 and 214. Each shelter 10 comprises two mating shelter halves, as illustrated in FIG. 1 or FIG. *3c*, which are connected together by a plurality of shelter connectors 64 (see FIGS. 17 and 18). The joint between shelter halves is equipped with a weather seal 70 and a joint cover 72 (see FIG. 1). Vestibules 216 and 217 and side vestibules 218 and 219 are attached to the first row of shelters 210.

A second row 220 of three aligned shelters 10 is parallel to first row 210. Shelters 10 in the second row 220 are also connected together by two end-to-end connectors 222 and 224. Row 220 of shelters 10 also has an end vestibule 226 and a side vestibule 228.

A third row 230 of aligned shelters 10 is perpendicular to first row 210 and is connected to row 210 by vestibule 217. Third row 230 comprises two shelters 10 which are connected together by end-to-end connector 232.

For purposes of illustration of the possibilities and usefulness of the invention, a particular configuration is shown comprising two parallel rows 210 and 220 of three shelters 10 each aligned end-to-end, connected at their sides by two vestibules 218 and 219, and further comprising a third row 230 of two aligned shelters, connected end-to-end, and with its side connected by vestibule 217 to the end of the first row 210 of shelters 10. However, the number of variables in arranging a shelter complex is endless. Once it is understood that: the number of rows can be varied, the number of shelters in each row can be varied, the number of vestibules attached to either the ends of shelters or to the sides of end-to-end connectors can be varied, and that a row of shelters can be attached to other rows of shelters with its main axis either parallel or perpendicular to the other rows of shelters, then it will also be understood that the number of permutations and combinations of arrangements of shelter complexes which are within the scope of the invention is infinite.

Figure 50:
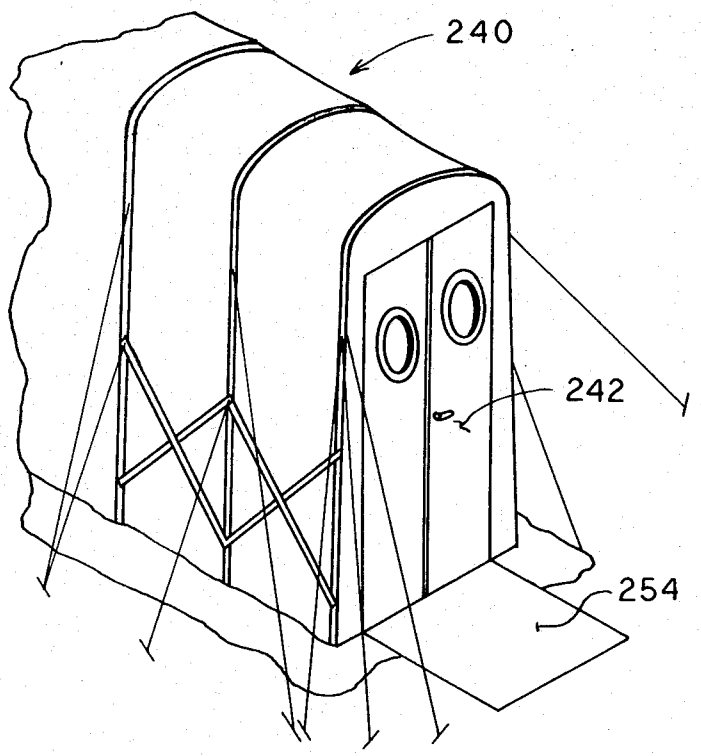
FIG. 50 is a perspective view showing details of a vestibule.
Figure 51:
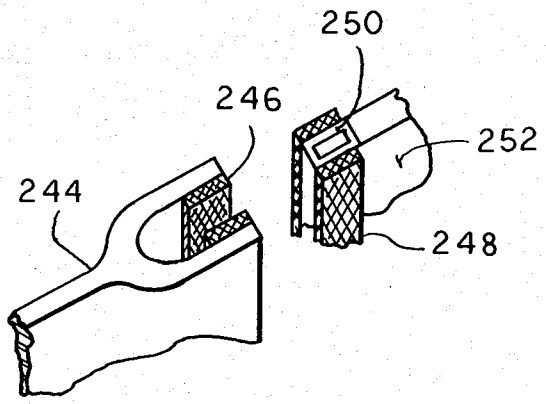
FIG. 51 is a perspective view showing how the vestibule doors of FIG. 50 are mounted using hook and pile fastener tape.

The vestibule 240 shown in FIG. 50 is an entranceway to the front of a shelter or to the side of an end-to-end connector or serves as a corridor between two end-to-end connectors. Vestibule 240 can either have a soft fabric 5 doorway which rolls up, such as is shown on the front end of the shelter of FIG. *3c*, or it may have a set of hardwall doors 242 which swing open on hinges. The vestibule 240 is built so that either a soft wall or hard wall door can be inserted into the vestibule's fastener tape "Y" 10 connection 244 shown in FIG. 51. This "Y" configuration 244, which is permanently a part of the fabric attached to the vestibule, consists of fabric with pile fastener tape 246 sewn on both legs of the "Y." The doorway has hook fastener tape 248 attached to both the front and the back 15 of the door edge 250. Thus, when the door 252 is inserted into the "Y" connection, it has a weather tight seal along both sides and the top.

The hard wall doors 252 are preferably constructed of a honeycomb material which is both lightweight and rigid. The door edges 250 are an aluminum tubing framework, which provides a good surface to which hook fastener tape 248 can be bonded, and is also stiff enough to provide a substantial hinge as it pivots about the edge of the "Y" connection 244. A ramp 254 is provided at both the front and back of doors 242 to allow carts with wheels to ride smoothly over the doorway frame bottom. These ramps 254 fold up when striking the shelter so that they lie flush with the door's surface.

Figure 52:
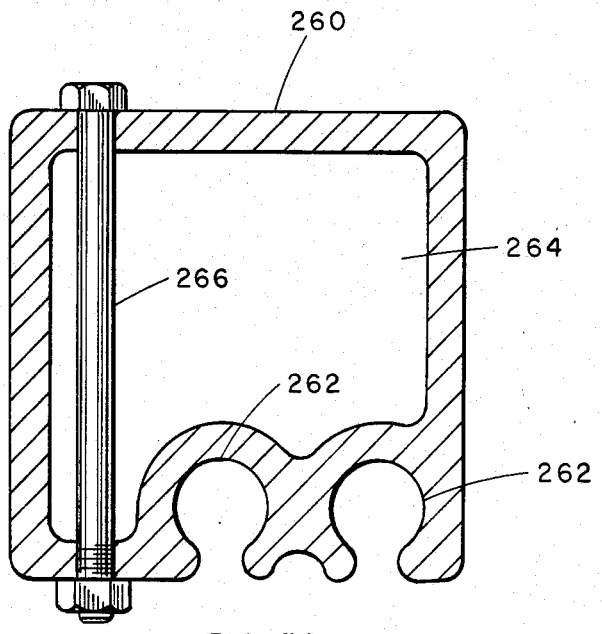
FIG. 52 is a cross-sectional view of an alternative embodiment of the aluminum alloy extrusion shown in FIG. 11.

FIG. 52 shows a cross sectional view of an alternative embodiment 260 of the extrusion 14 shown in FIG. 11. Extrusion 260 is preferably fabricated from aluminum alloy. The extrusion 260 has double channels 262 for receiving fabric beads, such as 54, shown in FIG. 9. To reduce the weight of the extrusion 260, it has been designed with a closed cross-section having a hollow portion 264. Bolt 266 is used to attach the lower portion of the X-braces 104 to the extrusion 262 (see FIG. 32).

FIGS. 53–60 inclusive show an alternative embodiment 270 of hinge 24, shown in FIGS. 4 and 5. This hinge 270 is preferably made of zinc aluminum alloy. The hinge 270 is designed to fit inside the end portion of an extrusion with which it is used, thus eliminating any need for welding of the hinges in place. Hinge 270 has no protruding parts. Both hinge leaves 272 are identical, thus eliminating left and right hand parts. Hinge assembly 270 is also designed to close 120 degrees to permit the folding of the shelter.

Figure 53:
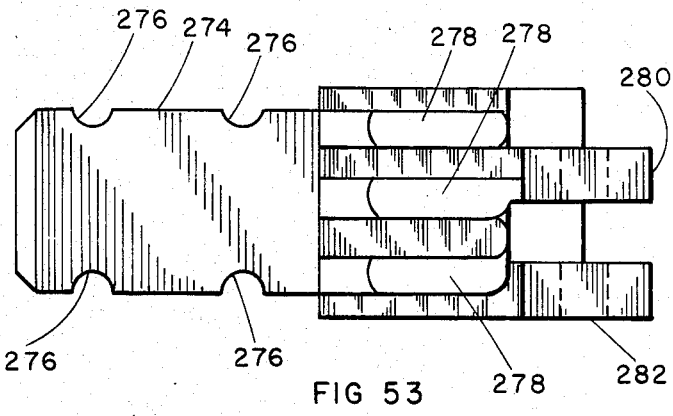
FIG. 53 is a plan view of an alternative arrangement of the hinge shown in FIGS. 4 and 5.
Figure 54:
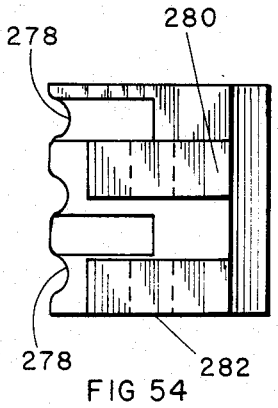
FIG. 54 is an end view of the alternative hinge shown in FIG. 53.
Figure 55:
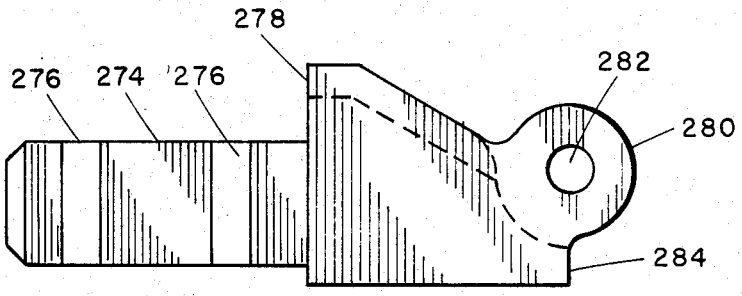
FIG. 55 is a side view of the hinge shown in FIG. 53.
Figure 56:
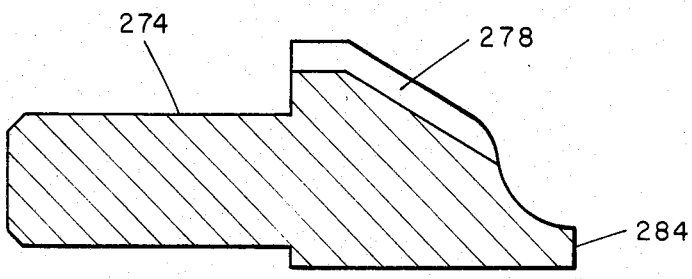
FIG. 56 is a sectional view of the hinge shown in FIG. 53, taken along line 56—56 of FIG. 53.

FIG. 53 shows a plan view of one leaf 272 of hinge 270. At one end of leaf 272 is a solid extrusion projection 274 designed to fit into the hollow portion of an extrusion 14 (see FIG. 11). Projection 274 contains a plurality of staking grooves 276 used to stake the projection 274 to an extrusion. On top of leaf 272 is shown a plurality of grooves 278, provided so that the fabric cover 11 (see FIG. 57) can move in close to the hinge 270 when cover 11 comes out of a slot 262 in the extrusion 260. This prevents large gaps between the cover and the hinge and pinching of the fabric cover 11 when the shelter is folded. At the opposite end of hinge leaf 272, interlocking hinge pivot projections 280 may be seen. These projections 280 each have a hole 282, used to pin the two hinge leaves 272 together. In the end view of hinge leaf 272 shown in FIG. 54, grooves 278 may be plainly seen. In the side view of hinge leaf 272 shown in FIG. 55, one may see, just below projection 280, a small flat surface 284, which acts as a stop when two hinge leaves 272 are opened all the way. FIG. 56 shows a sectional view of leaf 272, taken along line 56—56 of FIG. 53. In this view it may be clearly seen that fabric grooves 278 tilt downward at a 30 degree angle toward the pivot point (not shown) of the hinge leaf 272.

Figure 57:
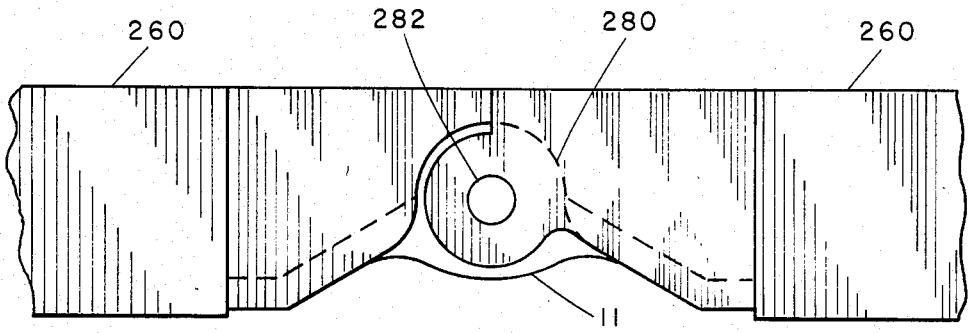
FIG. 57 is a side view of the hinge shown in FIG. 53, attached to the extrusions.
Figure 58:
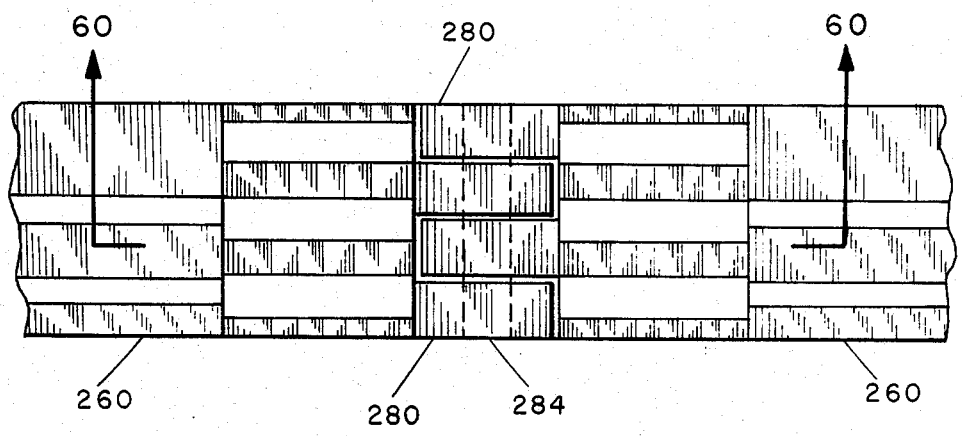
FIG. 58 is a plan view of the hinge shown in FIG. 53, attached to the extrusions.
Figure 59:
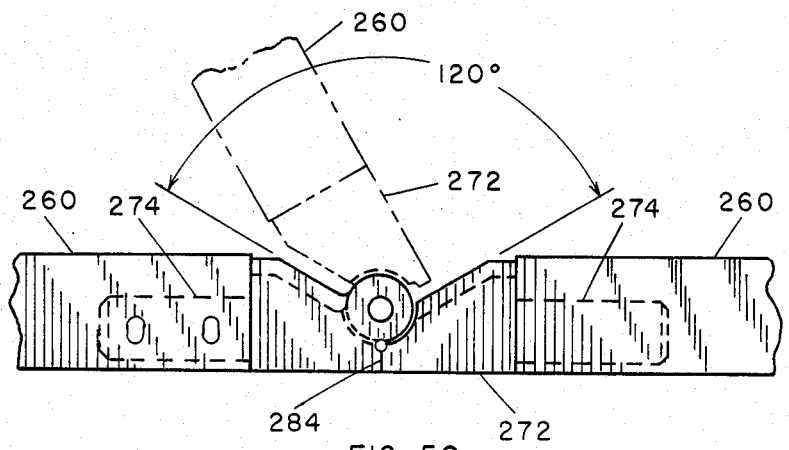
FIG. 59 is a side view of the hinge shown in FIG. 53, shown with the hinge fully open. The right hand leaf is also shown in phantom in a position rotated counterclockwise 120 degrees in order to illustrate the hinge in closed position.
Figure 60:
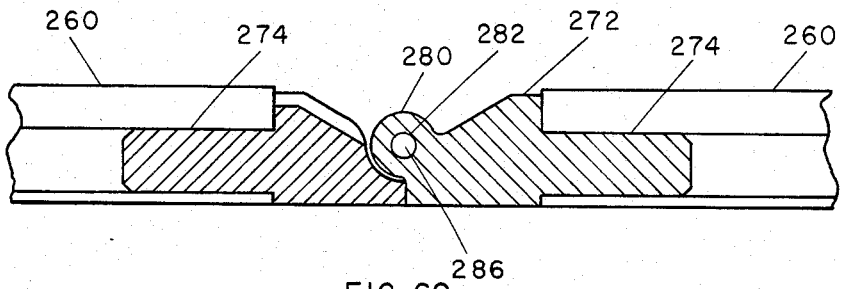
FIG. 60 is a sectional view of the hinge shown in FIG. 53, taken along line 60—60 of FIG. 58.

FIG. 57 is a side view of hinge 270 attached to extrusions 260. Fabric cover 11 is attached to the extrusions 260 through its leads 54 (FIG. 9 or FIG. 12), as described above. A fold in the cover 11 is shown in the vicinity of hinge projections 280. FIG. 58 is a plan view of hinge 270, attached to extrusions 260. Holes 282 through hinge projections 280 accommodate hinge or dowel pin 286. FIG. 59 is a side view of hinge 270, shown in the fully open position. The hinge leaf 272 on the right is also shown in phantom, rotated 120 degrees counterclockwise, in the fully closed position. FIG. 60 is a sectional view of the hinge 270, taken along line 60—60 of FIG. 58.

Figure 61:
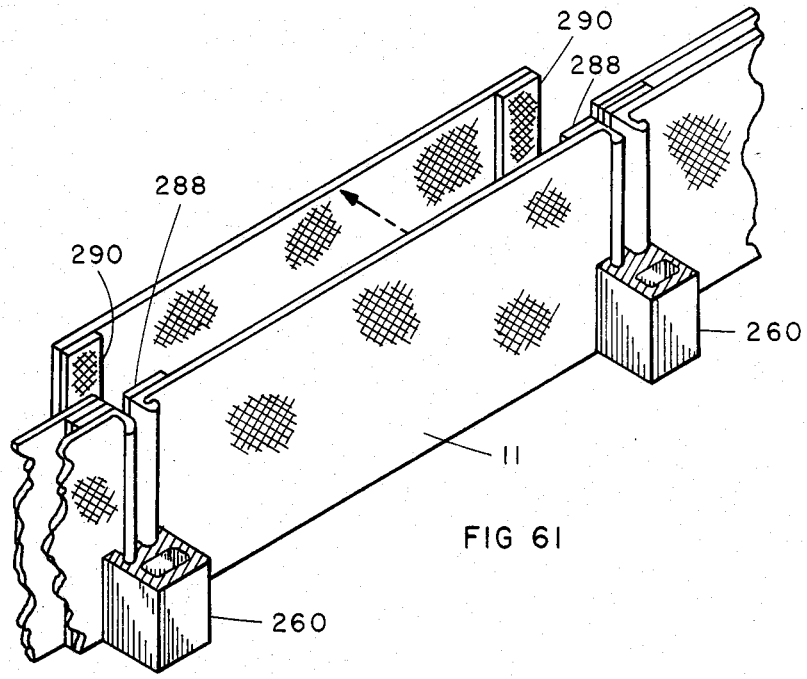
FIG. 61 is a pictorial exploded view illustrating how liner panels are installed inside cover panels of the same size.

The shelter 10 as depicted in FIG. 1, FIG. 3*a*, and FIG. 3*c* may be used with a liner 287 installed inside to increase reflectivity of the inner side of cover 11 or to provide additional insulation for heating and cooling. FIG. 61 illustrates how liner panels 287 are installed over cover panels 11 of the same size. The liner 287, which is preferably made of a thermal insulator fabric, may be attached to the inside of the cover 11 by the use of interlocking hook strips 288 (fastened to the back of cover panels 11, behind beads 54) and pile strips 290 (fastened to the back of the ends of liner panels 287).

Figure 62:
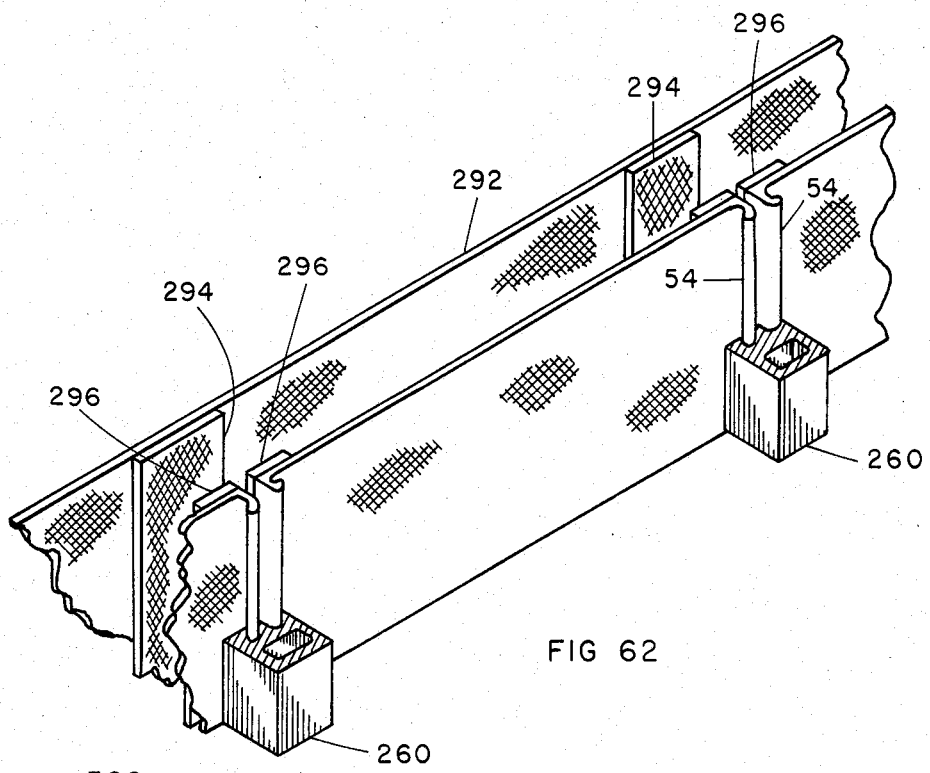
FIG. 62 is a pictorial exploded view illustrating how larger liner panels or continuous liner panels may be installed inside cover panels of the same size.

FIG. 62 illustrates how larger liner panels 292 (or one-piece liners) may be installed over cover panels 11. Wide pile strips 294 attached to the back of wide liner panels 292 are properly spaced and arranged so that they overlap and cover two adjacent hook strips 296. Each of the hook strips 296 is attached to the back (inside) end of one of the two adjacent cover panels 11.

Figure 63A:
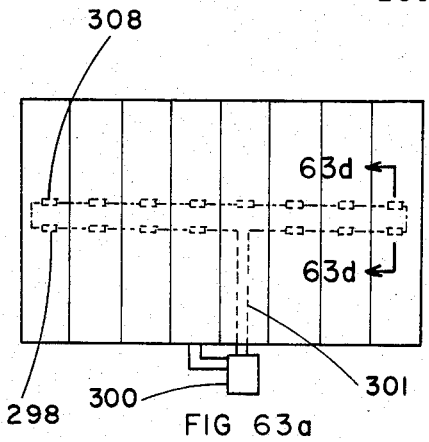
FIG. 63*a* is a diagram, shown in plan view, illustrating a plenum (duct) installation in a shelter.
Figure 63B:
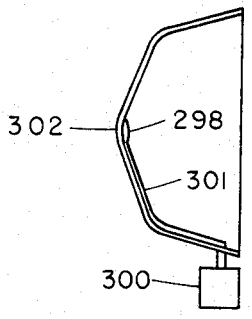
FIG. 63*b* is a diagram, shown in end view, of the plenum (duct) installation shown in FIG. 63*a*.

FIGS. 63*a*, 63*b*, 63*c*, and 63*d* show how a plenum (duct) for air conditioning or heating may be installed in a shelter 10 as part of the liner or thermal insulator. As shown in FIGS. 63*a* and 63*b*, the plenum 298 runs from the heater (or air conditioner) 300 outside the shelter 10 into the low side wall of shelter 10, up feeder duct section 301 to the ridge of the shelter and then along the ridge line 302 of the shelter 10.

Figure 63C:
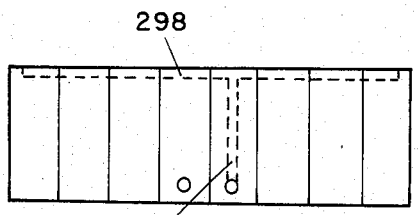
FIG. 63*c* is a side view of the plenum (duct) installation shown in FIG. 63*a*.
Figure 63D:
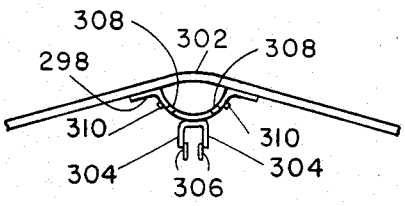
FIG. 63*d* is a sectional view taken along line 63*d*—63*d* of FIG. 63*a*, showing the installation of a plenum (duct) under the ridge of a shelter.

FIG. 63*c* is a side view of the plenum (duct) 298 installation shown in FIG. 63*a*. FIG. 63*d*, which is a sectional view of plenum 298 taken along line 63*d*—63*d* of FIG. 63*a*, shows additional structural details relating to plenum 298. Plenum 298 is attached to the inside of liner 287. Vent covers 304 hang down from the lower part of plenum 298 and have pile fasteners 306 attached to covers 304. Vents 308 may be covered by swinging the vent covers 304 up and pushing pile fasteners 306 against hook fasteners 310 on the outside of plenum 298.

Figure 64:
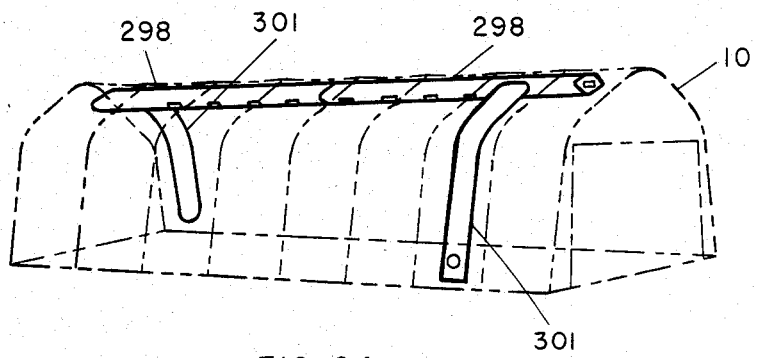
FIG. 64 is a diagram showing the installation of a plenum in a large shelter, with the shelter shown in phantom.

FIG. 64 is a diagram showing the installation of a plenum 298 in a medium or large shelter 10, such as is shown in FIG. 48. In this view, shelter 10 is shown in phantom. Note that two identical plenum sections 298, each one serving one half-shelter or shelter 10, may be connected together end-to-end so that the shelter 10 has one long plenum 298, with each plenum section being connected to its own feeder duct section 301. This allows either one or two heaters (air conditioners) 300 to be connected to shelter 10.

Figure 65:
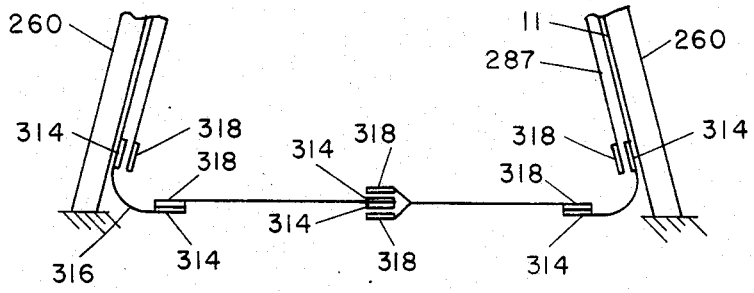
FIG. 65 is a cross-sectional diagram showing the lower part of a large shelter and illustrating a floor split lenthwise and installed in a shelter.
Figure 66:
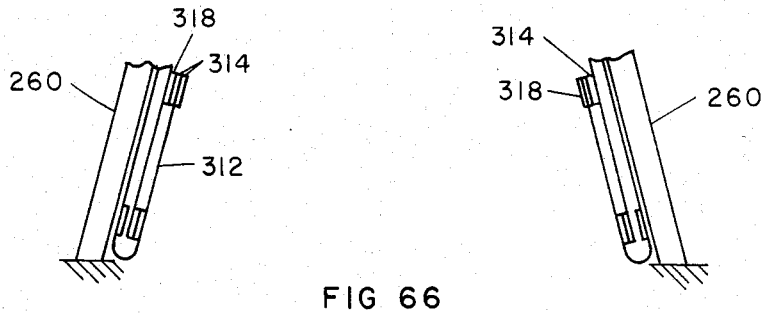
FIG. 66 is a cross-sectional diagram showing the shelter floor of FIG. 65 arranged to be moved, with each half lifted and attached to the shelter wall.

FIGS. 65 and 66 illustrate how a floor 312 is installed so as to allow it to be on the shelter 10 during erection, striking, folding, and shipping. The floor 312 is attached by wide hook and pile fastener tapes 314 and 318 respectively to an extension of the vinyl fabric cover 11 which is folded inward at ground level. On each side of the shelter 10, a section of hook fastener tape 314 attached to cover extension 316 mates with a section of pile fastener tape 318 on each side of the shelter 10. Tapes 314 and 318 are both about four inches wide, so as to provide a four inch fit adjustment on either side of shelter 10. Floor 312 is split lengthwise down the center line .pa into two halves, which also are attached together by wide hook tape 314 and wide pile tape 318, as shown in FIG. 65. into two halves, which also are attached together by wide hook tape 314 and wide pile tape 318, as shown in FIG. 65.

Figure 67:
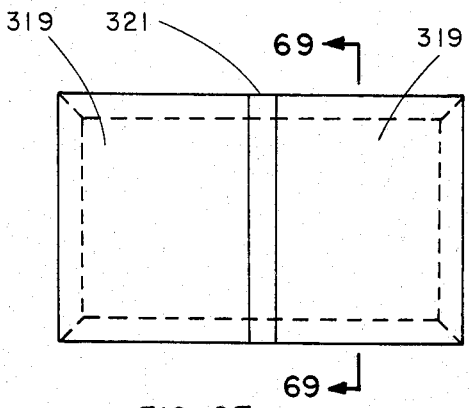
FIG. 67 is a diagrammatic plan view showing how the floors of two shelter halves are joined and overlapped.
Figure 68:
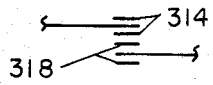
FIG. 68 is a diagram showing how the floors of the two shelter halves shown in FIG. 67 are fastened together.
Figure 69:
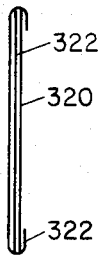
FIG. 69 is a cross-sectional view, taken along line 69—69 of FIG. 67, showing the arrangement of a shelter floor with an insulator panel below a cover panel.

When shelter 10 has to be moved, floor 312 is unhooked along the center line and each half is lifted and attached to the liner panel 11, as shown in FIG. 66. The base floor 312 is preferably made from lightweight vinyl fabric. When an insulated floor is required, it is made as shown in FIGS. 67, 68, and 69. The insulated floor panels 319 from two half shelters for a large shelter 10 overlap at lateral seam 321, as shown in FIG. 67, with mating wide hook tape fasteners 314 and wide pile fasteners 318, as shown in FIG. 68. As shown in the cross-sectional view of FIG. 69, which is taken along line 69—69 of FIG. 67, a layer of polypropylene insulator 320 is covered by a layer of vinyl coated nylon 322. This floor has an R-value of 1.22, thus providing good insulation, considering that it is lightweight material.

FIGS. 70 through 80 show an alternative embodiment of the eave extenders 17, which are shown on FIGS. 1 and 2. The alternative embodiment, the thermal barrier non-detachable spring stand-off 324 (or 327) may be installed on a rib member 12 of a shelter 10 in FIGS. 79 and 80. Stand-offs 324 and 327 are permanently attached to the expandable shelter 10. They may be erected to a given height above the rib members 12 and then collapsed when not in use.

Figure 80:
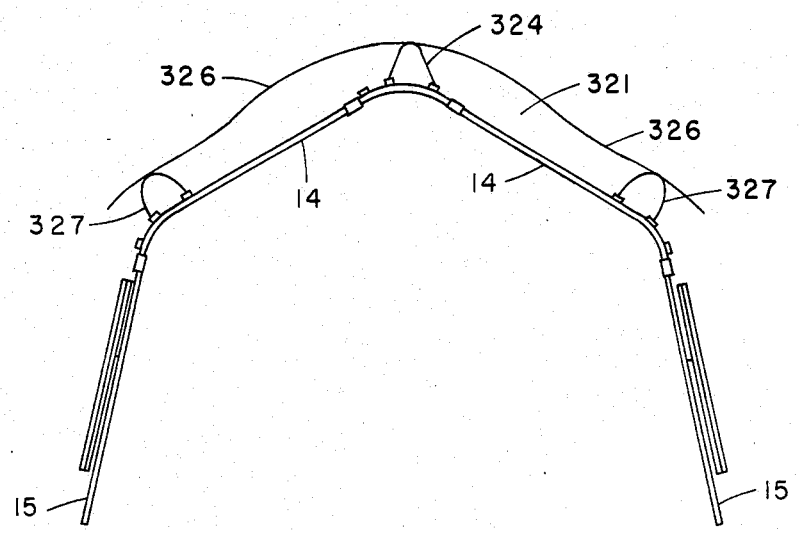
FIG. 80 is a side view of the shelter shown in FIG. 79 after it has been erected and with the thermal barrier attached to the shelter above the stand-offs.
Figure 79:
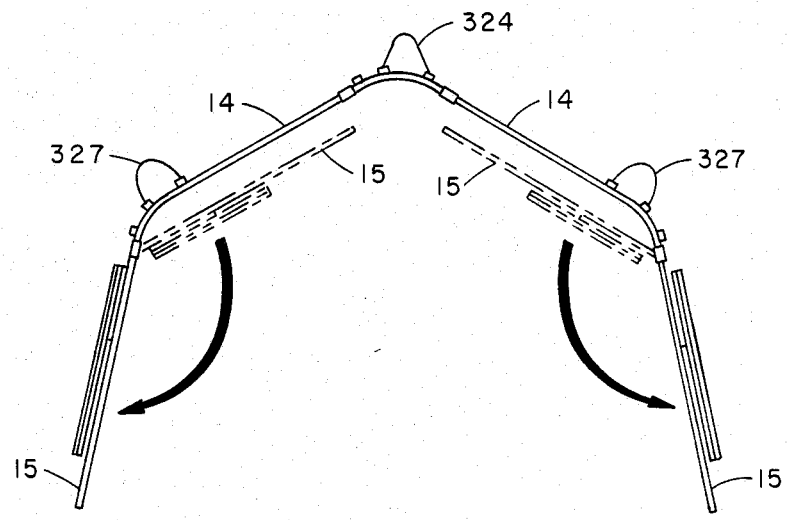
FIG. 79 is a plan view of the folded shelter as shown in FIG. 78 with the legs of the shelter in full extended position.

As may be seen best in FIGS. 79 and 80, the purpose of stand-offs 324 and 327 is to provide for the attachment of a thermal barrier 326, made of fabric, in order to allow the creation of an air pocket 321 between the barrier 326 and the ribs 12 supporting the roof of the shelter 10.

Figure 70A:
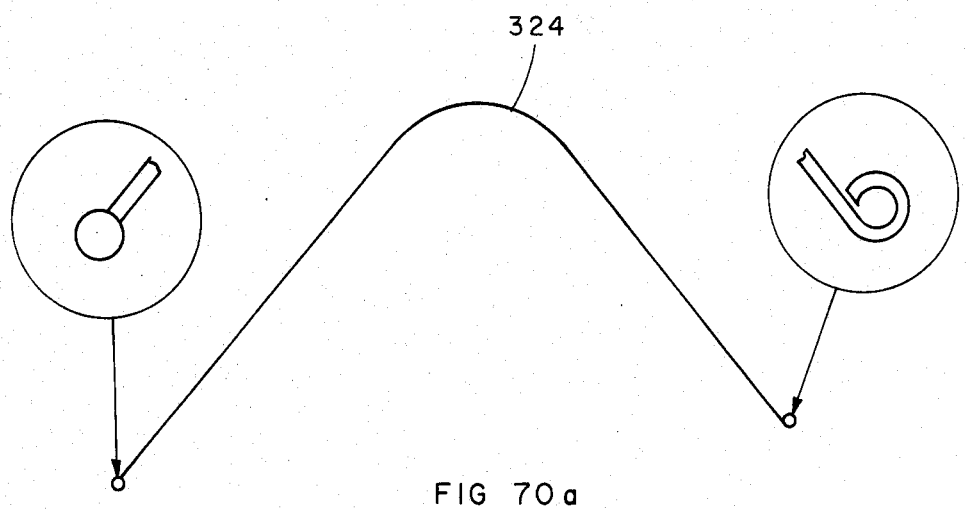
FIG. 70*a* is a diagram showing a ridge stand-off for a shelter.
Figure 70B:
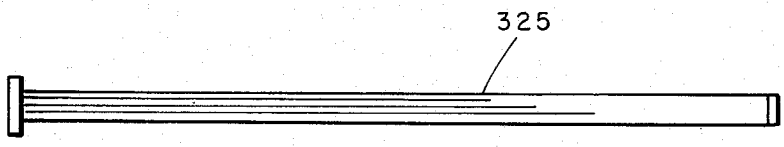
FIG. 70*b* is a diagram showing the ridge stand-off of FIG. 70*a* in flat position before forming.
Figure 71A:
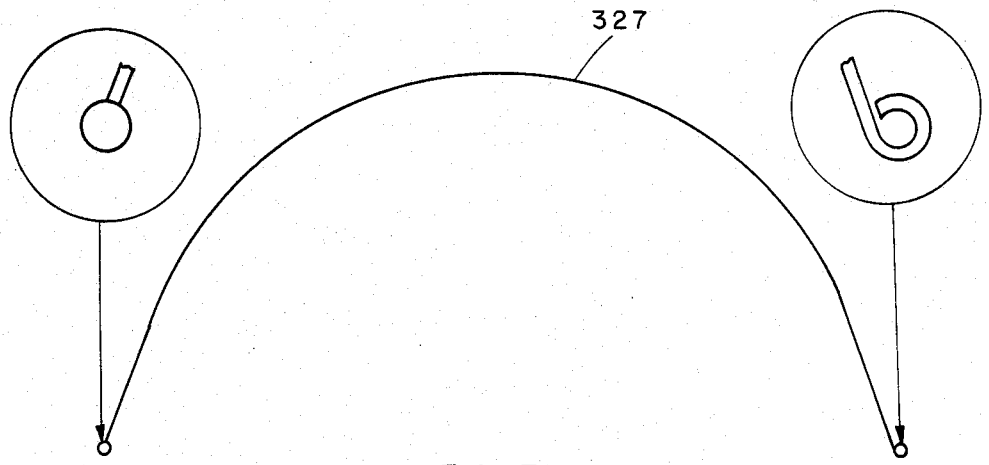
FIG. 71*a* is a diagram showing an arm stand-off for a shelter.
Figure 71B:
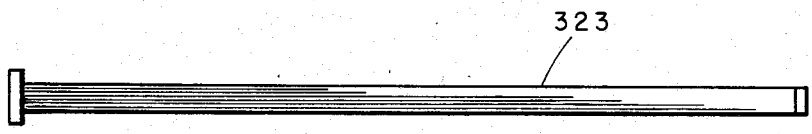
FIG. 71*b* is a diagram showing the arm stand-off of FIG. 71*a*, in flat position before forming.
Figure 72A:
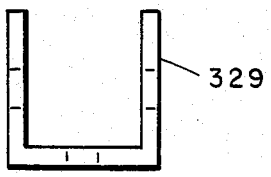
FIG. 72*a* is an end view of a pivot support base for a shelter stand-off.
Figure 72B:
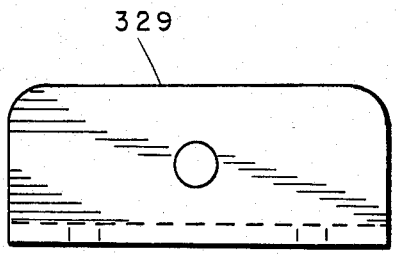
FIG. 72*b* is a side view of a pivot support base for a shelter stand-off.

When stand-offs 324 and 327 were designed, it was decided to permanently attach this type of stand-off to eliminate the necessity of attaching and detaching the stand-off 324 (or 327) to eliminate the possibility of losing detachable stand-offs. It was also decided to design the stand-off 324 (or 327) to have memory ability, so that it will resume a predetermined shape. Therefore, in the preferred embodiment of the stand-off 324 (or 327), spring steel was selected as a preferred material. A piece of flat spring steel 325, such as is shown in FIG. 70*b* may be formed into a ridge stand-off 324 (shown in FIG. 70*a*). Likewise, a large piece of flat spring steel 323, such as is shown in FIG. 71*b*, may be formed into an arm stand-off 327 (shown in FIG. 71*a*). The spring steel 323 or 325 is then heat treated to a specific hardness, which allows the steel to remember this form. When deforming force is applied and then removed, the steel will return to its original form.

Figure 73A:
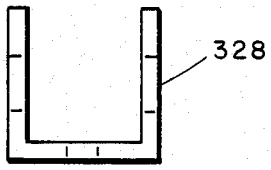
FIG. 73*a* is an end view of a latch support base for a shelter stand-off.
Figure 73B:
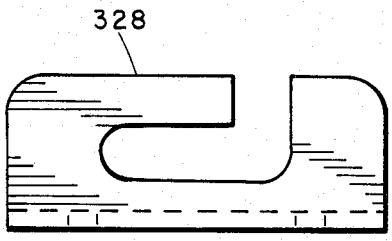
FIG. 73*b* is a side view of a latch support base for a shelter stand-off.
Figure 74:
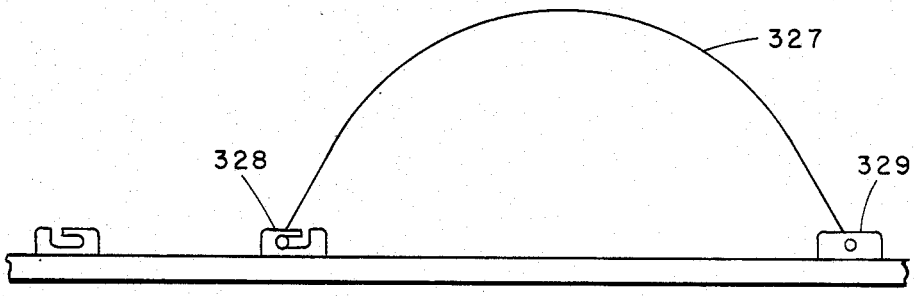
FIG. 74 is a spring stand-off for a shelter, latched and slightly compressed.
Figure 75:
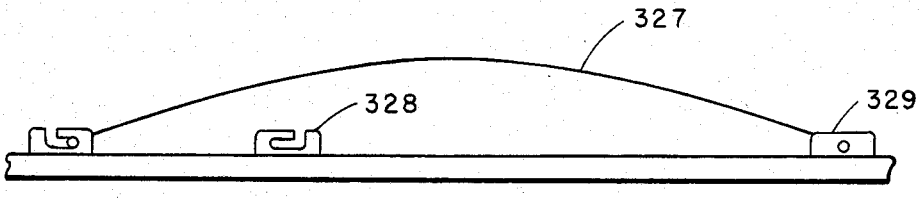
FIG. 75 is a spring stand-off for a shelter, latched and greatly compressed.
Figure 76:
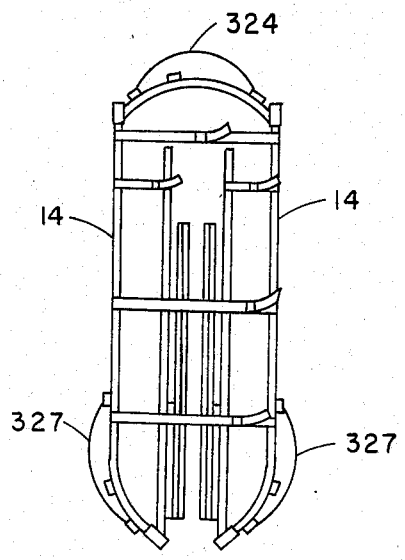
FIG. 76 is a plan view of a folded shelter in storage with a ridge stand-off and two arm stand-offs in view.
Figure 77:
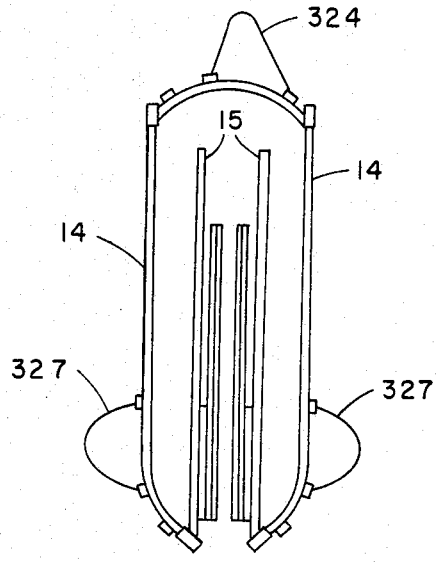
FIG. 77 is a plan view of the folded shelter as shown in FIG. 76 with the stand-offs shown in erected configuration.

For operation of the stand-offs 324 and 327, a pivot base (FIGS. 72*a* and 72*b*) is made to hold the stand-offs 324 and 327 in place on the shelter 10. When the stand-offs 324 and 327 are engaged to extend the thermal barrier 326 away from the roof of the shelter 10, the post ends of the stand-offs 324 and 327 are inserted into the latch base 328 (FIGS. 73*a* and 73*b*). The stand-offs 324 and 327 are then locked into position by slight spring compression (FIG. 74). In this position, air can flow freely between the roof of the shelter 10 and the thermal barrier 326. When the shelter 10 is struck, the stand-offs 324 and 327 are removed from the latch base 328 and inserted into another latch base 330 facing in the opposite direction (FIG. 75). Here, the spring stand-off 324 (or 327) is deformed and greatly compressed. This causes the 30 stand-offs 324 and 327 to lie closer to the shelter 10 framework, which allows for a tighter folded configuration for transporting (see FIG. 76). The stand-offs 324 and 327 are then erected prior to the shelter 10 set-up (FIG. 77).

Figure 78:
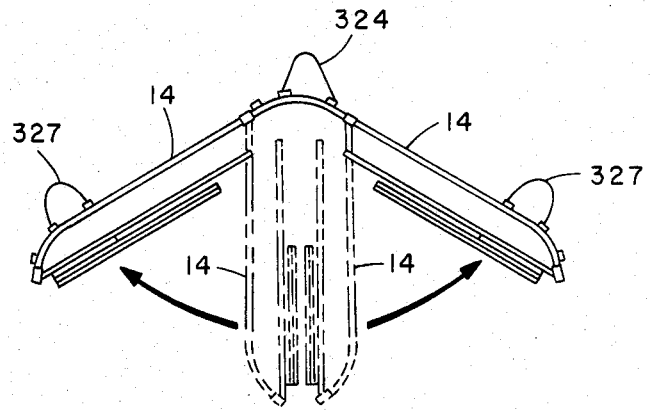
FIG. 78 is a plan view of the folded shelter as shown in FIG. 77 with the arms of the shelter in full extended position.

FIGS. 78 through 80 show the steps of erecting the shelter 10 with ridge stand-off 324 and arm stand-offs 327 already erected. In FIG. 78, arms 14 are unfolded outward. FIG. 79 shows legs 15 being unfolded outward. FIG. 80 shows the shelter 10 in erected position with the thermal barrier 326 attached to the shelter 10, creating air pocket 321 between barrier 326 and the top of the shelter 10. If desired, barrier 326 may be permanently attached to the shelter 10 in this fashion.

Several additional features of shelter 10 have been incorporated into the design. A liner, preferably made of spun bonded or other moisture-repelling material and preferably white or light in color, has been added to resist condensation and insulate the inside of the shelter. Air conditioning ducts have been incorporated into the liner material to allow air currents to be distributed evenly throughout the shelter. Third, window openings have been equipped with clear plastic windows, window screens, and an opaque flap to provide options for outside light, ventilation, or blackout, as desired.

As herein described, the present invention provides a greatly improved expandable utility structure which is lighter in weight, easier to manufacture, and easier to repair than the Cummins shelter, or any other shelter previously known. Double grooves have been placed in opposite sides of the aluminum extrusion ribs for easy and fast detachment of the shelter's fabric material to and from the folding frame. Also, the extruded ribs provide a hidden folding bar and slide system when the shelter is folded, thus eliminating protruding bolts, nuts, washers, and metal bars present on some prior art shelters. The present invention may utilize either a single reinforcing member or X-shaped braces between adjacent ribs on each side of the frame. Next, a newly designed hinge is sturdier, longer lasting, and more foolproof than any hinges shown on known prior art devices. The new hinge has no protruding bolts, nuts, or washers which might tear the fabric and cause maintenance problems. A newly designed shelter connector solves the problem of connecting two shelters together after erection and facilitates the building of shelter complexes. Shelters may be grouped into large connected complexes by building rows of shelters with their ends connected by the use of end-to-end connectors and by connecting parallel and perpendicular rows of shelters through the use of tunnel-like vestibules which attach to the sides of the end-to-end connectors or to the ends of rows of shelters. The improved expandable shelter includes hardware allowing a fly cover to be quickly added to the shelter at any time, thereby providing additional protection from the sun and making the shelter cooler. The invention also includes methods of erecting and striking the shelters and an arrangement for grouping the shelters into shelter systems or complexes.

We claim:

1. An expandable utility shelter comprising:

a supporting framework comprising:

a plurality of parallel U-shaped structural rib members aligned in a longitudinal interconnected column, each said rib member comprising a curved, elongated ridge member for defining the top of each said rib member and for determining the slope of the roof, said ridge member having a high center and two ends pointing downward at an acute angle with the horizontal; two arms, each said arm extending downward, each said arm having an upper end and a lower end, said upper end of each of said arms being attached to one of said ends of said ridge member; and two legs, each leg being attached to said lower end of one of said arms;

a plurality of hinges for connecting said ridge members to said arm members and the opposite ends of said arm members to said leg members;

a plurality of X-shaped braces, said braces connecting each adjacent pair of said rib members on each side of said shelter, said braces comprising two elongated members pivotally connected together at their midpoints, each said elongated member having its lower end pivotally connected to one of said adjacent pair of rib members and having its upper end movably connected to the other one of said adjacent pair of rib members, said plurality of X-shaped braces being operative to push said rib members together in abutting relationship when said shelter is closed or to pull them apart in spaced relationship when said shelter is opened and to stabilize and maintain a parallel physical relationship between said rib members;

a flexible cover removably secured to each said rib member on the surface thereof facing inward toward the interior of said shelter and arranged to pleat inwardly between each pair of adjacent ribs, said cover comprising a plurality of separate panels, each said separate panel having elongated beads attached to its vertical sides;

wherein said rib members have a hollow, generally rectangular, closed cross section and a plurality of exterior surfaces, one said surface facing inward toward the interior of said shelter, said inward-facing surface having two adjacent channels recessed in it for receiving said beads attached to two adjacent panels of said cover, said two adjacent channels being located off center in said inward-facing surface of each of said rib members, the first one of said channels being located near the edge of said inward-facing surface and the second one of said channels being located near the center of said inward-facing surface; and an insulating and light reflecting liner system comprising:

a plurality of hook and pile fastener strips attached to the inside of said plurality of separate cover panels, one of said fastener strips being attached to the inside of each vertical edge of each said separate cover panel; and a plurality of separate liner panels, each said liner panel being the same height as said cover panels and configured in width to exactly cover a multiple of said separate cover panels, each said liner panel having a plurality of vertical hook and pile fastener strips, each said fastener strip attached to said liner panels being wide enough and spaced properly so as to cover and mate with the corresponding fastener strips on the inside of said cover panels, whereby said liner panels may be attached to the inside of said cover panels; and whereby said cover is within and substantially protected by said rib members when in their closed, abutting relationship.

2. The expandable utility shelter of claim 1 wherein the two vertical hook and pile fastener strips on the ends of the said liner panels are both the same width as the corresponding vertical fastener strips on the said cover panels and wherein all said vertical fastener strips on said liner panels intermediate to said two end vertical fastener strips are double width so as to cover the joints between adjacent cover panels and also cover and mate with both of the corresponding pair of vertical fastener strips attached to the ends of said adjacent cover panels.

3. An expandable utility shelter comprising:

a supporting framework comprising:

a plurality of parallel U-shaped structural rib members aligned in a longitudinal interconnected column, each said rib member comprising a curved, elongated ridge member for defining the top of each said rib member and for determining the slope of the roof, said ridge member having a high center and two ends pointing downward at an acute angle with the horizontal; two arms, each said arm extending downward, each said arm having an upper end and a lower end, said upper end of each of said arms being attached to one of said ends of said ridge member; and two legs, each leg being attached to said lower end of one of said arms;

a plurality of hinges for connecting said ridge members to said arm members and the opposite ends of said arm members to said leg members;

a plurality of X-shaped braces, said braces connecting each adjacent pair of said rib members on each side of said shelter, said braces comprising two elongated members pivotally connected together at their midpoints, each said elongated member having its lower end pivotally connected to one of said adjacent pair of rib members and having its upper end movably connected to the other one of said adjacent pair of rib members, said plurality of X-shaped braces being operative to push said rib members together in abutting relationship when said shelter is closed or to pull them apart in spaced relationship when said shelter is opened and to stabilize and maintain a parallel physical relationship between said rib members;

a flexible cover removably secured to each said rib member on the surface thereof facing inward toward the interior of said shelter and arranged to pleat inwardly between each pair of adjacent ribs, said cover comprising a plurality of separate panels, each said separate panel having elongated beads attached to its vertical sides;

wherein said rib members have a hollow, generally rectangular, closed cross section and a plurality of exterior surfaces, one said surface facing inward toward the interior of said shelter, said inward-facing surface having two adjacent channels recessed in it for receiving said beads attached to two adjacent panels of said cover, said two adjacent channels being located off center in said inward-facing surface of each of said rib members, the first one of said channels being located near the edge of said inward-facing surface and the second one of said channels being located near the center of said inward-facing surface; and an insulating and light reflecting liner system comprising:

a plurality of separate liner panels corresponding in size and number to said plurality of separate cover panels, each said liner panel having a vertical hook and pile fastener strip attached along the outside of each of its vertical edges; and a plurality of hook and pile fastener strips attached to the inside of said plurality of separate cover panels, one of said fastener strips being attached to the inside of each vertical edge of each said separate cover panel, whereby said fastener strips on said liner panels and said cover panels mate with each other so that one said liner panel may be attached to the inside of each said cover panel; and whereby said cover is within and substantially protected by said rib members when in their closed abutting relationship.

4. The expandable utility shelter of claim 3 wherein said insulating and light reflecting system comprises:

a ridge duct attached to the upper part of said separate liner panels for carrying heated or cooled air along the ridge of said shelter, said ridge duct having a plurality of vents spaced along its long axis; and a feeder duct having one end connected to said ridge duct and its other end connected to a heater or cooler for carrying heated or cooled air from said heater or cooler to said vents, said feeder duct running vertically up the side of and one of said separate liner panels being attached to said separate liner panel.

5. The expandable utility shelter of claim 4 wherein said ridge duct extends substantially the full length of the ridge of said shelter.

6. The expandable utility shelter of claim 4 wherein said shelter comprises two half shelters butted together and attached end-to-end and each said half shelter comprises one said ridge duct with one said feeder duct connected to it, said ridge ducts in said two half shelters being butted together and attached end-to-end, whereby said shelter may have heater-coolers attached to either one or both of said feeder ducts in said two attached half-shelters.

7. The expandable utility shelter of claim 4 comprising a plurality of vent covers attached to said duct, said vent covers being spaced along the long axis of said duct and arranged as to be capable of covering each said vent in said duct.

8. The expandable utility shelter of claim 7 wherein said vent covers are attached to the lower part of said duct and are arranged to hang down when not covering said vents.

9. The expandable utility shelter of claim 8 wherein said vent covers have pile fastener tape attached to said vent covers and corresponding hook fastener tape attached to the outside of said duct, whereby said vent covers may be positioned to cover said vents by swinging said vent covers up and pushing said hook fasteners against the corresponding said pile fasteners.

10. The expandable utility shelter of claim 3 wherein said separate cover panels each have a lower extension which is folded inward at ground level.

11. The expandable utility shelter of claim 10 comprising floor panels which are attached to said lower extension of said separate cover panels by the use of hook and pile fasteners.

12. The expandable utility shelter of claim 11 wherein said floor panels comprise two longitudinal panels which are attached together with hook and pile fasteners along a floor seam which runs down the middle of said shelter and along the long axis of said shelter.

13. The expandable utility shelter of claim 12 wherein said hook and pile fasteners used to attach said floor panels to said lower extensions of said cover panels are wide enough to allow several inches of fit adjustment at the junction of said floor panels and said cover panels.

14. The expandable utility shelter of claim 13 wherein said hook and pile faseteners used to attach said longitudinal floor panels together are wide enough to allow several inches of fit adjustment along said floor seam.

15. The expandable utility shelter of claim 14 wherein the inside of said liner panels are equipped with hook and pile fasteners at an appropriate height so that said longitudinal floor panels may be unhooked along said floor seam and said panels may be lifted and attached to the inside of said liner panels, whereby said expandable shelter may be struck and folded with the floor panels still installed.

16. The expandable utility shelter of claim 15 wherein said shelter comprises two half shelters butted together and attached end-to-end and the said floor panels for said two half shelters are configured so as to overlap along a lateral seam at the junction of said two half shelters, said floor panels being attached together with hook and pile fasteners.

17. The expandable utility shelter of claim 16 wherein said hook and pile fasteners along said lateral seam are wide enough to provide several inches of fit adjustment.

18. The expandable utility shelter of claim 12 wherein said floor panels comprise a layer of fabric covering a layer of insulation.

19. The expandable utility shelter of claim 18 wherein said floor panels comprise a layer of polypropylene insulation covered by vinyl coated nylon.

20. An expandable utility shelter comprising:

a supporting framework comprising:

a plurality of parallel U-shaped structural rib members aligned in a longitudinal interconnected column, each said rib member comprising a ridge member; two arms, each arm having an upper end and a lower end, the first of said arms being attached at its upper end to one end of said ridge member and the second arm being attached at its upper end to the opposite end of said ridge member; and two legs, each leg being attached to said lower end of one of said arms;

a plurality of hinges for connecting said ridge members to said arm members and the opposite ends of said arm members to said leg members;

a plurality of X-shaped braces, said braces connecting each adjacent pair of said rib members on each side of said shelter, said braces comprising two elongated members pivotally connected together at their midpoints, each elongated member having an upper end and a lower end, each said elongated member having its said lower end pivotally connected to one of said adjacent pair of rib members and having its said upper end movably connected to the other one of said adjacent pair of rib members, said plurality of X-shaped braces being operative to push said rib members together in abutting relationship when said shelter is closed or to pull them apart in spaced relationship when said shelter is opened and to stabilize and maintain a parallel physical relationship between said rib members;

a flexible cover removably secured to each said rib member on the side thereof facing the interior of said shelter and arranged to pleat inwardly between each pair of adjacent ribs;

wherein each said hinge comprises two identical hinge leaves and a hinge pin, each said hinge leaf having a first end which is rectangular in cross section and which is configured to mate with an open end of a part of one said rib member, so said first portion may be inserted into and fit snugly in said open end of said part of said rib member, and each said hinge leaf having a second end with two parallel sides, a first face, a second face parallel to said first face, a third face at an obtuse angle from said first face, a fourth face perpendicular to said second face, and a plurality of substantially circular, spaced projections attached to said second portion of said leaf, between said third and fourth faces, whereby the fourth faces on said two identical hinge leaves abut each other and thus provide a stop when said hinges are in the fully open position;

whereby said cover is within and substantially protected by said rib members when in their closed, abutting relationship.

21. The expandable utility shelter of claim 20 wherein each said projection has a circular opening at its center sized to receive said hinge pin.

22. The expandable utility shelter of claim 21 wherein said projections on each of said two leaves are arranged to mesh so as to provide a plurality of aligned circular openings to receive said hinge pin.

23. The expandable utility shelter of claim 22 wherein said second end portion of each said hinge leaf has a plurality of parallel grooves cut between said two parallel sides.

24. The expandable utility shelter of claim 23 wherein each one of said plurality of parallel grooves is cut into said first face and said third face and the bottom of each of said grooves runs parallel to said first and third faces, whereby said grooves provide space for folds of said flexible cover when said hinges are closed.

25. The expandable utility shelter of claim 24 wherein each said first end of each said hinge leaf has two sides parallel to said two parallel sides of said second end, each of said parallel sides of said first end has at least one staking groove cut into it, whereby each said first end of each said leaf hinge may be permanently attached to one said open end of said rib member.

26. The expandable utility shelter of claim 24 wherein said second end of said hinge leaves are configured so that said third face of each hinge leaf makes an interior angle of 120 degrees with the said first face of the same hinge leave whereby said third faces of said two identical hinge leaves on each said hinge abut each other and thus provide a stop when said hinge is fully closed, thus allowing said two identical hinge leaves to rotate 120 degrees with respect to each other in moving from the fully open to the fully closed position.

27. The expandable utility shelter of claim 26 wherein said second end of each said hinge leaf has two said circular spaced projections.

28. The expandable utility shelter of claim 27 wherein said second end of each said hinge leaf has three said grooves.

29. An expandable utility shelter comprising:

a supporting framework comprising:

a plurality of parallel U-shaped structural rib members aligned in a longitudinal interconnected column, each said rib member comprising a ridge member; two arms, each arm having an upper end and a lower end, the first of said arms being attached at its upper end to one end of said ridge member and the second arm being attached at its upper end to the opposite end of said ridge member; and two legs, each leg being attached to said lower end of one of said arms;

a plurality of hinges for connecting said ridge member to said arm members and the opposite ends of said arm members to said leg members;

a plurality of X-shaped braces, said braces connecting each adjacent pair of said rib members on each side of said shelter, said braces comprising two elongated members pivotally connected together at their midpoints, each elongated member having an upper end and a lower end, each said elongated member having its said lower end pivotally connected to one of said adjacent pair of rib members and having its said upper end movably connected to the other one of said adjacent pair of rib members, said plurality of X-shaped braces being operative to push said rib members together in abutting relationship when said shelter is closed or to pull them apart in spaced relationship when said shelter is opened and to stabilize and maintain a parallel physical relationship between said rib members;

a flexible cover removably secured to each said rib member on the side thereof facing the interior of said shelter and arranged to pleat inwardly between each pair of adjacent ribs;

a plurality of thermal barrier stand-offs attached to each said rib member, each said stand-off comprising:

an elongated piece of flat spring metal;

a pivot base attached to said rib member; and a latch base attached to said rib member at a distance from said pivot base less than the length of said piece of flat spring metal; and whereby:

said cover is within and substantially protected by said rib members when in their closed, abutting relationship;

said thermal barrier is supported above said utility shelter so as to provide protection for said shelter against sun and rain and to provide a dead-air space between said thermal barrier and said shelter for thermal insulation; and a first end of said piece of spring metal may be pivotally attached to said pivot base and the second end of said piece of spring metal may be latched to said latch base.

30. The expandable utility shelter of claim 29 wherein each said stand-off comprises two latch bases spaced apart, whereby the second end of each said piece of spring metal may be attached to a near latch base when said stand-off is in the erected position and to a far latch base when said stand-off is in the folded position.

31. The expandable utiity shelter of claim 30 wherein each said latch base is configured as a bracket and said second end of each said piece of spring metal is equipped with an end fitting which fits into said latch base.

32. The expandable utility shelter of claim 31 wherein said near latch base is a bracket with its open end facing towards said pivot base and said far latch base is a bracket with its open end facing away from said pivot base, whereby said piece of spring metal is under slight compression when it is attached to said near latch base and it is deformed and under great pressure when it is attached to said far latch base.

33. The expandable utility shelter of claim 32 wherein each said rib member has one of said stand-off attached to its ridge member and one said stand-off attached to each of its arms.

* * * * *